US012721494B2

(12) United States Patent
Lee et al.

(10) Patent No.: US 12,721,494 B2
(45) Date of Patent: Sep. 1, 2026

(54) DISHWASHER

(71) Applicant: LG Electronics Inc., Seoul (KR)

(72) Inventors: Youmin Lee, Seoul (KR); Jindong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 144 days.

(21) Appl. No.: 18/723,619

(22) PCT Filed: Nov. 11, 2022

(86) PCT No.: PCT/KR2022/017740

§ 371 (c)(1),
(2) Date: Jun. 24, 2024

(87) PCT Pub. No.: WO2023/120980

PCT Pub. Date: Jun. 29, 2023

(65) Prior Publication Data

US 2025/0057386 A1 Feb. 20, 2025

(30) Foreign Application Priority Data

Dec. 24, 2021 (KR) ..... 10-2021-0187690

(51) Int. Cl.
*A47L 15/22* (2006.01)
*A47L 15/10* (2006.01)
*A47L 15/42* (2006.01)

(52) U.S. Cl.
CPC ..... *A47L 15/22* (2013.01); *A47L 15/10* (2013.01); *A47L 15/4225* (2013.01)

(58) Field of Classification Search
CPC ..... A47L 15/10; A47L 15/16; A47L 15/18; A47L 18/20; A47L 15/22; A47L 15/23; A47L 15/4225; A47L 15/4278; A47L 15/428; A47L 15/4282
See application file for complete search history.

(56) References Cited

U.S. PATENT DOCUMENTS

2017/0354308 A1 12/2017 Choi et al.
2019/0343366 A1 11/2019 Lee

FOREIGN PATENT DOCUMENTS

CN 106175635 12/2016
CN 109394111 A 3/2019
CN 109589066 A 4/2019
CN 109589068 A 4/2019
(Continued)

OTHER PUBLICATIONS

Extended European Search Report in European Appln. No. 22911618.1, mailed on Sep. 17, 2025, 11 pages.

*Primary Examiner* — David G Cormier
(74) *Attorney, Agent, or Firm* — Fish & Richardson P.C.

(57) ABSTRACT

A dishwasher includes a tub, a sump, a pump configured to supply the washing water stored in the sump to a washing space of the tub, and a spray arm configured to discharge the washing water from the pump into the washing space. A channel is defined inside the spray arm to spray the washing water into the washing space or discharge the washing water containing microbubbles into the washing space. The spray arm includes an upper cover and a lower cover coupled to a lower side of the upper cover. A flat surface is defined at one of the upper cover or the lower cover. The other of the upper cover or the lower cover comprises a pair of inner ribs that protrude toward the flat surface to define the channel and are in contact with the flat surface.

14 Claims, 21 Drawing Sheets

(56) References Cited

FOREIGN PATENT DOCUMENTS

| | | | |
|---|---|---|---|
| CN | 209863731 | | 12/2019 |
| CN | 110876599 | A | 3/2020 |
| CN | 111407205 | | 7/2020 |
| KR | 1997-0003428 | Y1 | 4/1997 |
| KR | 10-1737845 | | 5/2017 |
| KR | 10-2017-0139801 | | 12/2017 |

DISHWASHER

CROSS-REFERENCE TO RELATED APPLICATIONS

This application is a National Stage application under 35 U.S.C. § 371 of International Application No. PCT/KR2022/017740, filed on Nov. 11, 2022, which claims the benefit of Korean Patent Application No. 10-2021-0187690, filed on Dec. 24, 2021. The disclosures of the prior applications are incorporated by reference in their entirety.

TECHNICAL FIELD

The present disclosure relates to a dishwasher, and more specifically, to a dishwasher that washes dishes with washing water including microbubbles.

BACKGROUND

A dishwasher is a device that removes dirt from dishes by spraying washing water. For example, the dishwasher sprays washing water into the washing space through a spray arm placed inside a tub. In some cases, a spray channel through which the washing water flows may be formed inside the spray arm.

In a couple process of the spray arm, it may be difficult to perform the coupling at the same position between ribs, and errors may occur at certain intervals.

In some cases, when a cross-sectional area of the channel defined inside the spray arm is very small, the size or shape of the channel may be deformed due to errors caused by the fusion coupling. When the channel is relatively small, changes in the size or shape of the channel may impede the function of the channel.

SUMMARY

The present disclosure describes a dishwasher that improves dishwashing performance by using washing water including microbubbles.

The present disclosure further describes a dishwasher that can secure a size and cross-sectional area of the channel formed inside the spray arm.

The present disclosure further describes a dishwasher that maintains the flow of washing water sprayed from the spray arm and generates microbubbles using a part of the washing water.

According to one aspect of the subject matter described in this application, a dishwasher includes a tub that defines a washing space, a sump disposed below the tub and configured to store washing water received from the tub, a pump configured to supply the washing water stored in the sump to the washing space, and a spray arm configured to discharge the washing water from the pump into the washing space, where the spray arm defines a channel therein configured to carry the washing water received from the pump, the spray arm being configured to spray the washing water or the washing water including microbubbles into the washing space. The spray arm includes an upper cover and a lower cover that have inner surfaces facing each other, the lower cover being coupled to a lower side of the upper cover. The spray arm has (i) a flat surface that is defined at one of the inner surfaces of the upper cover and the lower cover, and (ii) a pair of inner ribs that protrude from the other of the inner surfaces of the upper cover and the lower cover to the flat surface, the pair of inner ribs being in contact with the flat surface to thereby define the channel between the pair of inner ribs.

Implementations according to this aspect can include one or more of the following features. For example, the upper cover and the lower cover can be coupled to each other by fusion in a state in which the pair of inner ribs are in contact with the flat surface. In some implementations, the flat surface is disposed above and spaced apart from a bottom surface of the lower cover, and the pair of inner ribs protrude downward from the upper cover. In some examples, the upper cover further includes a pair of support ribs that are spaced apart from the pair of inner ribs and protrude toward the lower cover. In some examples, the pair of support ribs protrude from the upper cover to the bottom surface of the lower cover and are in contact with the bottom surface of the lower cover.

In some implementations, the channel defined by the pair of inner ribs and the flat surface has a rectangular cross section. In some examples, a cross section of the channel has (i) a first side that is defined by a straight line and (ii) a second side that is defined by a curved line, bent lines, or a plurality of straight lines. In some implementations, the spray arm includes a first blade configured to spray the washing water into the washing space, and a second blade configured to supply the washing water including the microbubbles to the washing space, where the channel includes (i) a spray channel defined inside the first blade and (ii) a bubble generating channel defined inside the second blade. The upper cover can include an upper rib that protrudes downward, and the lower cover can include a lower rib that protrudes upward to the upper rib to thereby define the spray channel between the upper cover and the lower cover, where the flat surface and the pair of inner ribs are disposed in the second blade and define at least a portion of the bubble generating channel.

In some examples, the spray arm defines (i) an intake hole that is in fluid communication with an outside of the spray arm and configured to provide air to the bubble generating channel and (ii) a supply channel configured to supply the washing water discharged from the pump to at least one of the spray channel or the bubble generating channel. The bubble generating channel can include (i) a connection channel connected to the supply channel, the connection channel being defined by the flat surface and the pair of inner ribs, (ii) a buffer chamber connected to the connection channel and the intake hole, the buffer chamber having a cross-sectional area that increases and then decreases along a direction away from the connection channel, (iii) an air intake channel configured to receive the air from the intake hole via the buffer chamber, and (iv) a discharge channel connected to the air intake channel, the discharge channel having a cross-sectional area that increases in a direction away from the air intake channel. The spray arm can further define a discharge hole configured to discharge the washing water from the discharge channel to the outside of the spray arm.

In some examples, a cross-sectional area of the connection channel is smaller than a cross-sectional area of an inlet end of the supply channel. In some examples, a cross-sectional area of the connection channel is smaller than a cross-sectional area of the air intake channel.

In some implementations, the flat surface is defined at the inner surface of the lower cover, and the pair of inner ribs protrude downward from the inner surface of the upper cover toward the lower cover. In some examples, the flat surface protrudes upward from a bottom surface of the lower cover to the pair of inner ribs of the upper cover. In some examples, a channel height of the channel between the flat surface and the inner surface of the upper cover is less than a height of the flat surface protruding from the bottom surface of the lower cover. In some examples, the flat surface extends laterally outward relative to the pair of inner ribs, and a channel width of the channel between the pair of inner ribs is less than a lateral width of the flat surface.

In some implementations, by placing a bubble generating channel in the spray arm, washing water including generated microbubbles can be supplied to the washing water discharged into the tub. The washing water including the generated microbubbles supplied to the tub can be circulated through the sump and sprayed onto the dishes. The washing water containing the microbubbles has the advantage of effectively cleaning contamination from dishes.

In some implementations, a flat surface is formed on one cover, and a pair of ribs protruding from one cover is disposed on the other cover, which has the advantage of securing the desired shape and size of the channel.

In some implementations, the connection channel formed in the second blade has a small cross-sectional area, so that a flow rate of washing water supplied to the spray channel can be secured. Therefore, it has the advantage of securing the amount of washing water sprayed from the spray arm and generating microbubbles at the same time.

The effects of the present disclosure are not limited to the effects mentioned above, and other effects not mentioned may be clearly understood by those skilled in the art from the description of the claims.

DETAILED DESCRIPTION

Hereinafter, the present disclosure will be described with reference to drawings for explaining the dishwasher according to the one or more implementations of the present disclosure.

In some implementations, a dishwasher of the present disclosure includes a cabinet that defines an outer appearance of the dishwasher, a tub 2 that is disposed inside the cabinet and forms a washing space 2*s*, a sump 3 that is disposed below the tub 2 and temporarily stores washing water, a spray arm 10 that sprays washing water into the washing space 2*s*, and a washing pump that supplies washing water stored in the sump 3 to the spray arm 10. The spray arm 10 may be rotatably placed in the tub 2 or sump 3.

The washing water stored in the sump 3 may flow to the washing space 2*s* of the tub 2 through the washing pump and spray arm 10, and the washing water sprayed into the washing space 2*s* of the tub 2 may flow to the sump 3 again.

Figure 1:
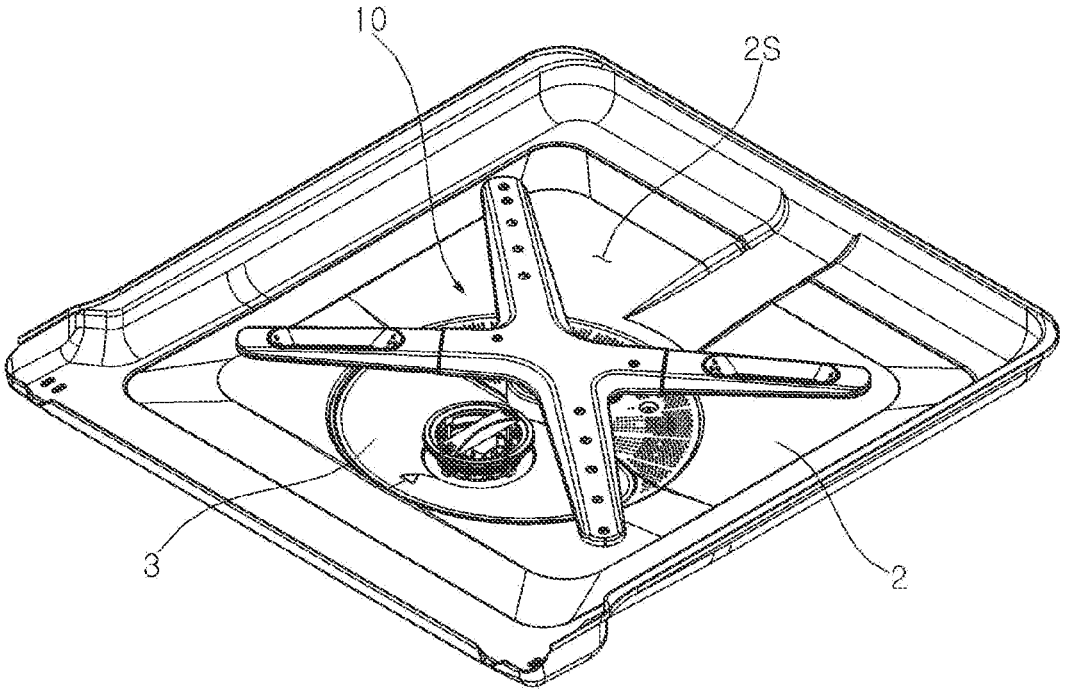
FIG. 1 is a perspective view showing an example of a spray arm mounted on a bottom surface of a tub.

FIG. 1 illustrates one spray arm 10, for example. In some implementations, additional spray arms may be disposed in the washing space 2*s*.

Figure 2:
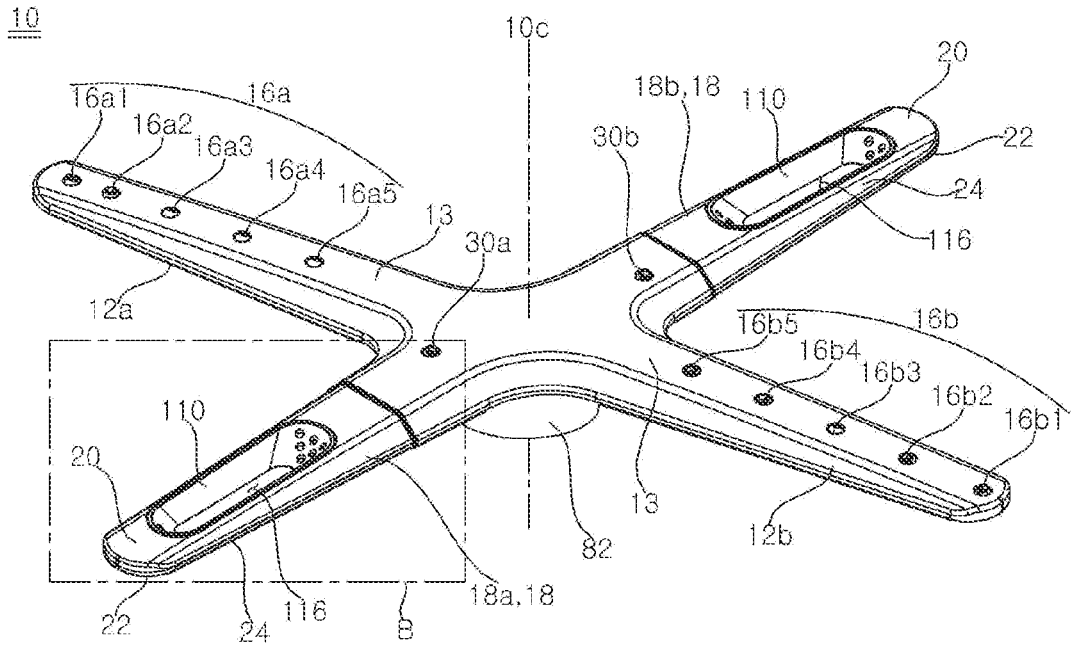
FIG. 2 is a perspective view of the spray arm.
Figure 3:
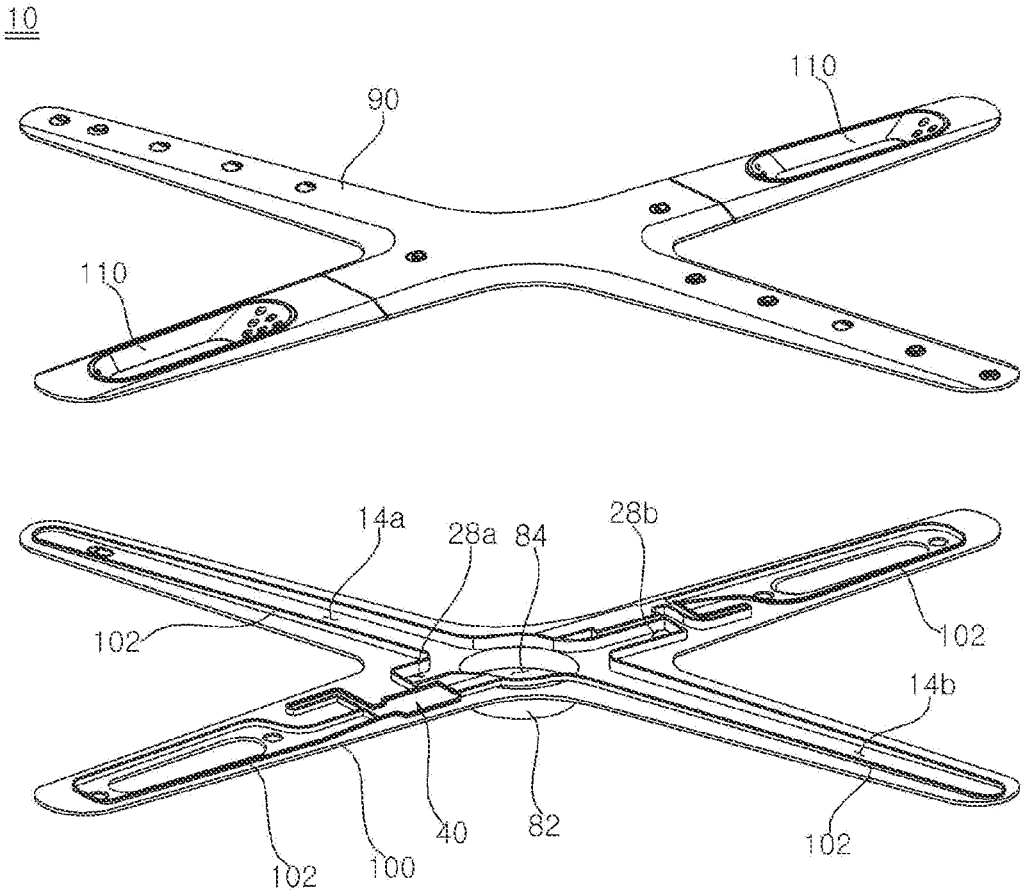
FIG. 3 is an exploded perspective view of the spray arm.

Referring to FIGS. 2 and 3, the spray arm 10 includes first blades 12*a* and 12*b* that spray the washing water into the washing space 2*s* inside the tub 2, a second blade 18 that supplies microbubbles to the washing space 2*s*, and a hub 82 that supplies washing water supplied from the washing pump to the first blades 12*a* and 12*b* or the second blade 18.

The first blades 12*a* and 12*b* have spray channels 14*a* and 14*b* through which the washing water flows. The first blades 12*a* and 12*b* may have a structure extending centrifugally from the hub 82. Inside the first blades 12*a* and 12*b*, the spray channels 14*a* and 14*b* are formed in a direction extending centrifugally from the hub 82. A plurality of spray nozzles 16*a* and 16*b* spaced apart in the radial direction may be disposed on an upper surface 13 of the first blades 12*a* and 12*b*. The plurality of spray nozzles 16*a* and 16*b* disposed on the upper surface 13 of the first blades 12*a* and 12*b* are spaced apart in the radial direction. The first blades 12*a* and 12*b* are configured to spray washing water supplied from the washing pump to the washing space.

The second blade 18 has a bubble generating channel 40 forming microbubbles inside. In the second blade 18, discharge holes 108*a*, 108*b*, and 118 are formed to discharge the microbubbles generated through the bubble generating channel 40. A discharge channel 70 through which the microbubbles generated through the bubble generating channel 40 flow to the discharge holes 108*a*, 108*b*, and 118 is formed inside the second blade 18. The internal channel of the second blade 18 is described in detail below.

Figure 4:
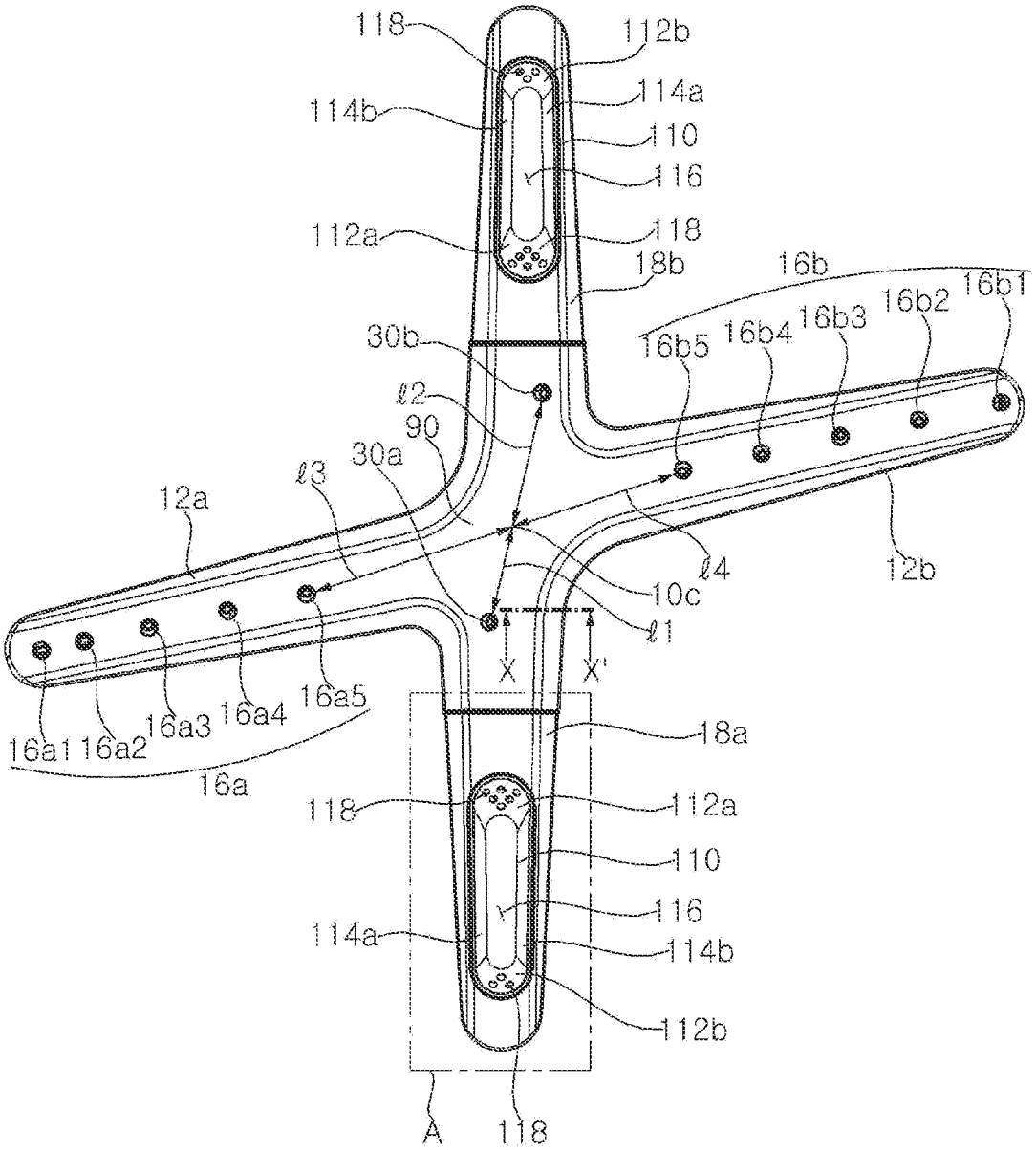
FIG. 4 is a plan view of the spray arm.
Figure 5:
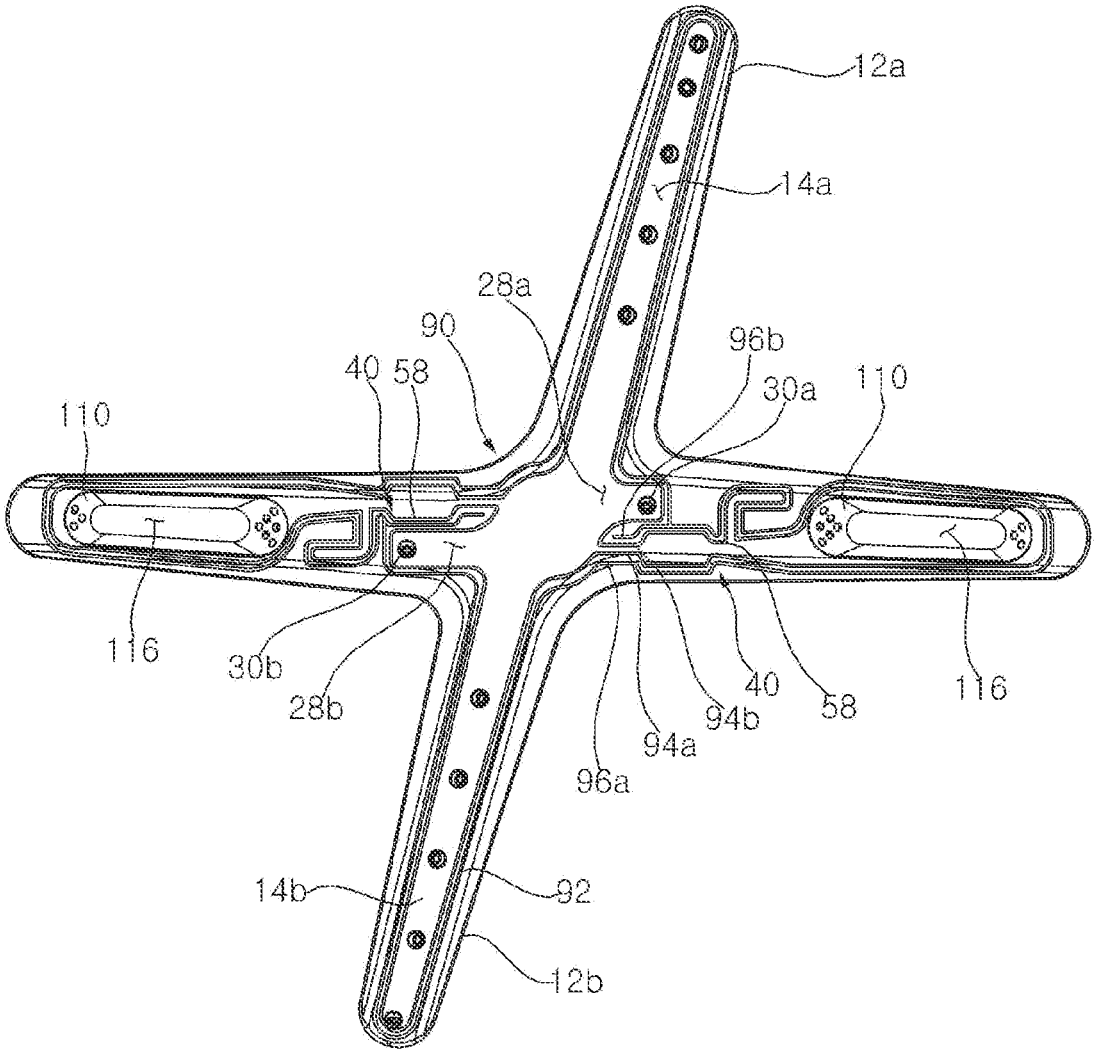
FIG. 5 is a bottom view showing an example of an upper cover.

Additional spray channels 28*a* and 28*b* which spray the washing water into the washing space 2*s* may be formed inside the second blade 18. The additional spray channels 28*a* and 28*b* may be disposed on one side of a buffer chamber 44 of the bubble generating channel 40. Additional spray nozzles 30*a* and 30*b* which spray the washing water flowing through the additional spray channels 28*a* and 28*b* into the washing space 2*s* may be disposed on an upper surface 13 of the second blade 18. There may be differences between distances 11 and 12 at which the additional spray nozzles 30*a* and 30*b* are separated from the center of the hub 82 and distances 13 and 14 at which the spray nozzles 16*a* and 16*b* are separated from the center of the hub 82. Referring to FIG. 4, the distance 11, 12 at which the additional spray nozzles 30*a* and 30*b* are spaced from the center of the hub 82 are smaller than the distances 13 and 14 at which the spray nozzles 16*a* and 16*b* are separated from the center of the hub 82.

The spray arm 10 may include at least one first blades 12*a* and 12*b*. The spray arm 10 may include a plurality of first blades 12*a* and 12*b*. The spray arm 10 may include one second blade 18. The spray arm 10 may include two second blades 18.

Referring to FIGS. 2 and 3, the spray arm 10 has a pair of first blades 12*a* and 12*b* arranged in opposite directions and a pair of second blades 18 disposed to intersect the pair of first blades 12*a* and 12*b*. However, unlike the drawing, the number or arrangement of the first blades 12*a*, 12*b* and the second blade 18 may be set differently.

The first blades 12*a* and 12*b* have a spray channel formed therein and includes a 1-1 blade 12*a* and a 1-2 blade 12*b* extending in opposite directions. The second blade 18 has a bubble generating channel formed inside and includes a second-1 blade 18*a* and a second-2 blade 18*b* extending in opposite directions.

Referring to FIGS. 2 and 3, the spray arm 10 includes the hub 82, the 1-1 blade 12*a* extending in one direction from the hub 82, the 1-2 blade 12*b* extending in the direction opposite to the 1-1 blade 12*a* from the hub 82, the 2-1 blade 18*a* extending in a direction between the 1-1 blade 12*a* and the 1-2 blade 12*b* from the hub 82, and the 2-2 blade 18*b* extending in the direction opposite to the 2-1 blade 18*a* from the hub 82.

A first spray channel 14*a* is formed inside the 1-1 blade 12*a*. A second spray channel 14*b* is formed inside the 1-2 blade 12*b*. A plurality of first injection nozzles 16*a*1, 16*a*2, 16*a*3, 16*a*4, and 16*a*5 are disposed on the upper surface of the 1-1 blade 12*a*. A plurality of second injection nozzles 16*b*1, 16*b*2, 16*b*3, 16*b*4, and 16*b*5 are disposed on the upper surface of the 1-2 blade 12*b*. Distances at which the plurality of first injection nozzles 16*a*1, 16*a*2, 16*a*3, 16*a*4, and 16*a*5 are spaced apart from a rotation center axis 10*c* of the spray arm 10 and distances at which the plurality of second injection nozzles 16*b*1, 16*b*2, 16*b*3, 16*b*4, and 16*b*5 are spaced apart from the rotation center axis 10*c* of the spray arm 10 may be different from each other.

A first bubble generating channel 40 and a first additional spray channel 28*a* are formed inside the 2-1 blade 18*a*. A second bubble generating channel 40 and a second additional spray channel 28*b* are formed inside the 2-2 blade 18*b*. A first additional spray nozzle 30*a* is disposed on the upper surface of the 2-1 blade 18*a*. A second additional spray nozzle 30*b* is disposed on the upper surface of the 2-2 blade 18*b*. A distance at which the first additional spray nozzle 30*a* is spaced apart from the rotation center axis 10*c* of the spray arm and a distance at which the second additional spray nozzle 30*b* is spaced apart from the rotation center axis 10*c* of the spray arm 10 may be different from each other.

A supply channel 84 extending in an up-down direction is formed inside the hub 82. The supply channel 84 may have a structure in which the upper end is closed and the lower end is open. Therefore, the washing water flowing from the washing pump is supplied to the lower side.

The spray channels 14*a* and 14*b* of the first blades 12*a* and 12*b* may be connected to the upper end portion of the supply channel 84. The bubble generating channel 40 of the second blade 18 may be connected to the upper end portion of the supply channel 84. Therefore, the washing water flowing upward along the supply channel 84 may flow into the spray channels 14*a* and 14*b* or the bubble generating channel 40.

Referring to FIG. 3, the spray arm 10 may include an upper cover 90 and a lower cover 100 coupled to the lower side of the upper cover 90. The upper cover 90 and lower cover 100 may be coupled to each other by fusion. Ribs 92 and 102 protruding in directions facing each other may be formed on the upper cover 90 or the lower cover 100. An upper rib 92 protruding downward may be disposed on the lower surface of the upper cover 90 facing the lower cover 100. A lower rib 102 protruding upward may be disposed on the upper surface of the lower cover 100 facing the upper cover 90.

The ribs 92 and 102 disposed on the upper cover 90 or lower cover 100 may form a channel formed inside the upper cover 90 and lower cover 100.

The ribs 92 and 102 forming the internal channel of the spray arm 10 may be disposed in at least one of the upper cover 90 and the lower cover 100.

Each of the upper cover 90 and lower cover 100 may form a part of each of the first blades 12*a* and 12*b*, the second blade, and the hub 82. When the upper cover 90 and the lower cover 100 are coupled to each other, the spray channels 14*a* and 14*b* inside the first blades 12*a* and 12*b* may be formed. When the upper cover 90 and the lower cover 100 are coupled to each other, the bubble generating channel 40 inside the second blade 18 may be formed. When the upper cover 90 and the lower cover 100 are coupled to each other, the discharge channel 70 inside the second blade 18 can be formed.

The spray arm 10 includes an inner side wall 110 in which a vertical hole 116 penetrating the upper cover 90 and the lower cover 100 in the up-down direction is formed. The vertical hole 116 formed inside the inner side wall 110. The vertical hole 116 is open in the up-down direction so that falling washing water can flow to the bottom surface of the tub 2.

The inner side wall 110 is connected to the upper cover 90 and the lower cover 100, respectively. The inner side wall 110 may have a plurality of discharge holes 108*a*, 108*b*, and 118 formed on one side surface. The discharge holes 108*a*, 108*b*, and 118 discharge washing water containing microbubbles discharged from the bubble generating channel 40 into the tub 2.

The inner side wall 110 may have a tubular shape extending from the top to the bottom. The inner side wall 110 may have a tubular shape whose diameter decreases from the top to the bottom. That is, the surface formed by the inner side wall 110 may be perpendicular to the rotation axis of the spray arm 10, or may have a shape inclined upward from the vertical direction. Accordingly, the discharge holes 108*a*, 108*b*, and 118 may be opened in a direction perpendicular to the rotation axis or above the direction perpendicular to the rotation axis. Accordingly, washing water sprayed through the spray nozzles 16*a* and 16*b* of the first blades 12*a* and 12*b* may fall into the discharge holes 108*a*, 108*b*, and 118 of the inner side wall 110. This may have the effect of applying pressure to the washing water containing the microbubbles discharged through the discharge holes 108*a*, 108*b*, and 118, thereby causing the microbubbles to be additionally broken.

The specific structure and shape of the inner side wall 110 will be described in detail below.

The spray channels 14*a* and 14*b* may have a shape extending centrifugally from the hub 82. The spray channel may be formed so that a channel cross-sectional area thereof decreases in a direction away from the hub 82.

The bubble generating channel 40 allows a portion of the washing water supplied from the hub 82 to flow, and air is suctioned and crushed into the flowing washing water to discharge the washing water containing microbubbles.

Hereinafter, with reference to FIGS. 7 to 12, the bubble generating channel will be described.

In some implementations, the bubble generating channel 40 includes a connection channel 42 connected to the supply channel 84 of the hub 82, a buffer chamber 44 connected to the connection channel 42 and having the increasing cross-sectional area in the channel, an air intake channel 56 which is connected to the buffer chamber 44 and through which external air flows in, and a discharge channel 70 connected to the air intake channel 56 and discharging washing water having the generated microbubbles.

Referring to FIGS. 7 to 12, in some examples, the bubble generating channel 40 may have a rectangular cross-section in the channel.

The connection channel 42 is connected to the supply channel 84 of the hub 82. The connection channel 42 may supply the washing water flowing from the supply channel 84 to the buffer chamber 44. The channel cross-sectional area of the connection channel 42 is smaller than the channel cross-sectional area at inlet ends of the spray channels 14*a* and 14*b*.

The buffer chamber 44 includes an expansion portion 50 in which the cross-sectional area of the channel increases, a maintenance portion 52 in which the cross-sectional area of the channel is maintained, and a reduction portion 54 in which the cross-sectional area of the channel is reduced.

Figure 8:
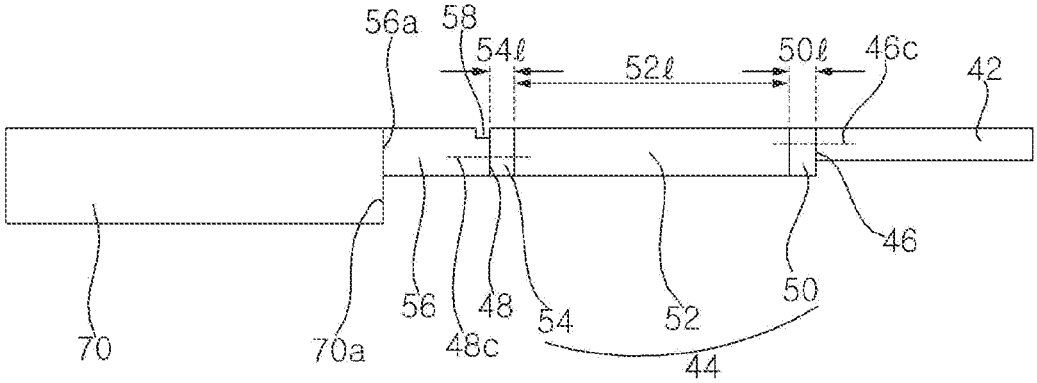
FIG. 8 is a side view of FIG. 7.
Figure 11:
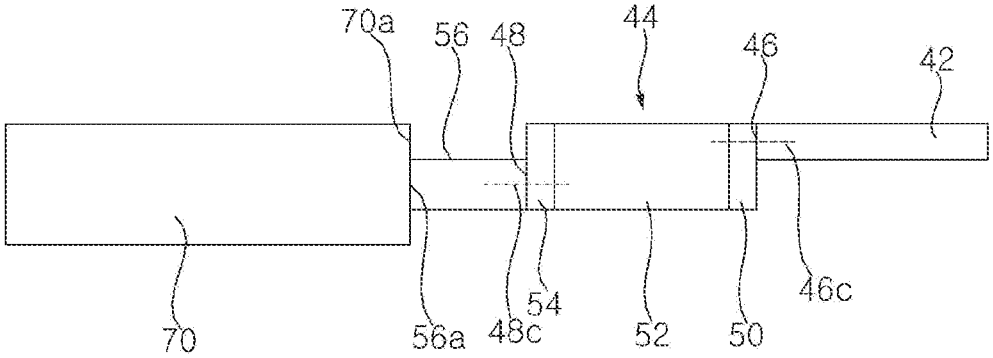
FIG. 11 is a side view of FIG. 10.

The cross-sectional area of the channel formed in the expansion portion 50 is larger than the cross-sectional area of the connection channel 42. Referring to FIGS. 8 and 11, the cross-sectional area of the channel at the inlet end portion of the expansion portion 50 is larger than the cross-sectional area of the discharge end portion of the connection channel 42. Accordingly, when the washing water flowing through the connection channel 42 flows into the buffer chamber 44, the flow rate may rapidly decrease. Additionally, as the expansion portion 50 moves in a flow direction of the washing water, the cross-sectional area of the channel rapidly expands, so the flow rate of the washing water may decrease. That is, the pressure of the washing water flowing into the buffer chamber 44 through the connection channel 42 may be lowered.

A length 501 of the expansion portion 50 extending in the flow direction of the washing water is shorter than a length 521 of the maintenance portion 52 extending in the flow direction of the washing water. The length 501 of the expansion portion 50 in a longitudinal direction is formed to be shorter than a length (t1+t2) of the expansion portion 50 expanding in a width direction. Accordingly, the flow rate of washing water flowing from the connection channel 42 into the buffer chamber 44 may be rapidly reduced.

The maintenance portion 52 may maintain the cross-sectional area of the channel expanded in the expansion portion 50. The length 521 of the maintenance portion 52 extending in the longitudinal direction may be longer than the length 501 of the expansion portion 50 extending in the longitudinal direction.

The reduction portion 54 extends from the end portion of the maintenance portion 52 in the flow direction of the washing water. The channel formed inside the reduction portion 54 is connected to the air intake channel 56 at a discharge end. Here, the discharge end of the reduction portion 54 may be an outlet 48 of the buffer chamber 44.

Since the cross-sectional area of the channel of the washing water flowing along the reduction portion 54 is reduced in the flow direction of the washing water, the pressure of the flowing washing water is lowered. Since the cross-sectional area of the channel of the washing water flowing along the reduction portion 54 decreases in the flow direction of the washing water, the flow speed of the flowing washing water increases. A length 541 of the reduction portion 54 extending in the flow direction of the washing water is shorter than a length 521 of the maintenance portion 52 extending in the flow direction of the washing water. The length 541 of the reduction portion 54 in the longitudinal direction is shorter than a length t3+t4 by which the reduction portion 54 is reduced in the width direction. The length 541 of the reduction portion 54 extending in the flow direction of the washing water may be similar to the length 501 of the expansion portion 50 extending in the flow direction of the washing water. That is, the length 541 of the reduction portion 54 in the longitudinal direction may be 0.8 to 1.2 times the length 501 of the expansion portion 50 in the longitudinal direction.

Here, the longitudinal direction may be the direction in which the second blade 18 extends. Additionally, the width direction may be perpendicular to the longitudinal direction.

Figure 9:
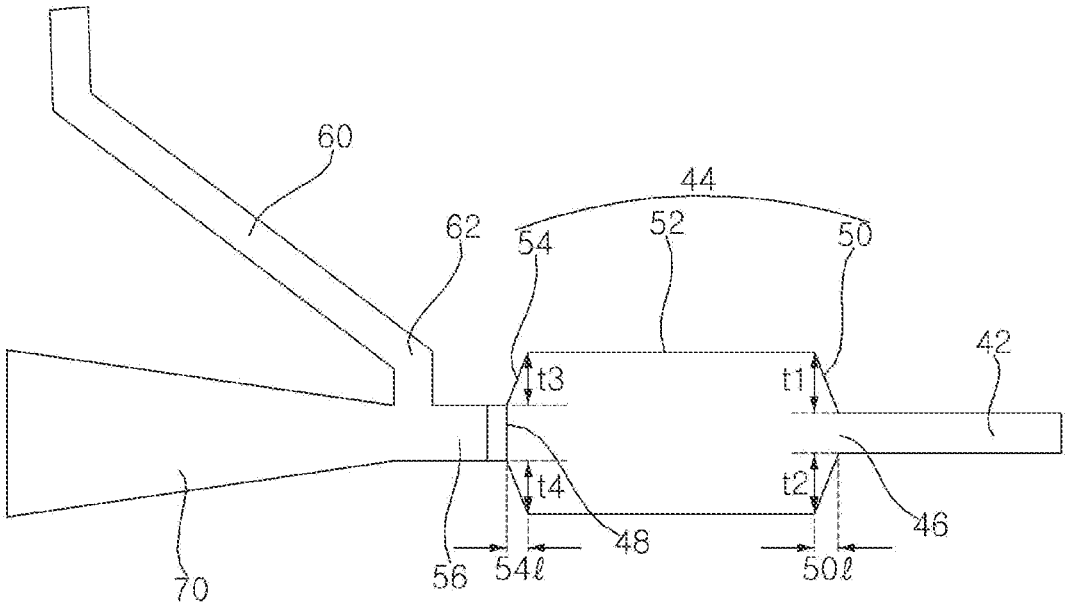
FIG. 9 is a plan view of FIG. 7.
Figure 10:
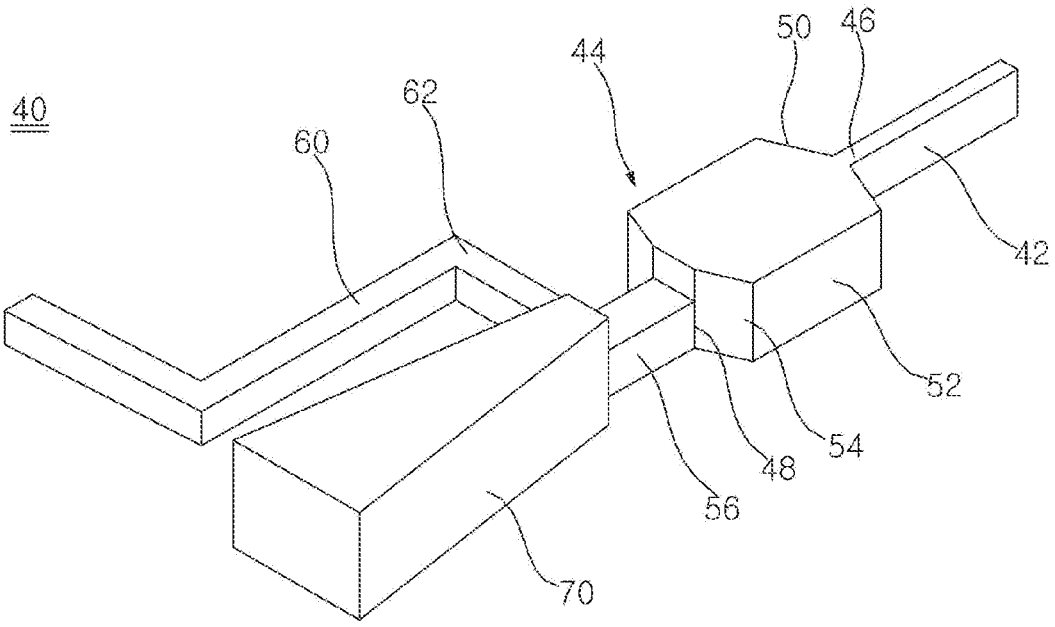
FIG. 10 is a perspective view showing an example of a bubble generating channel.
Figure 12:
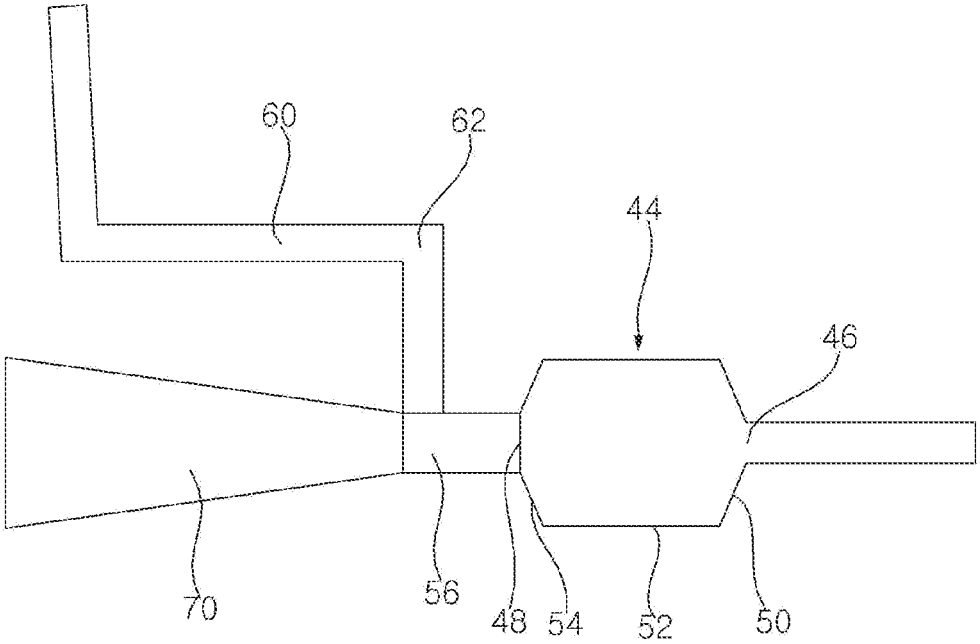
FIG. 12 is a plan view of FIG. 10.

Referring to FIGS. 8 and 11, the channel formed inside the buffer chamber 44 may be formed to have the same length in the up-down direction over the entire area. Referring to FIGS. 9 and 12, the channel formed inside the buffer chamber 44 may form the channel that expands, maintains, and contracts in the width direction.

An inlet 46 connected to the connection channel 42 and an outlet 48 connected to the air intake channel 56 may be formed in the buffer chamber 44. The inlet 46 may be a hole or channel formed at the inlet end of the buffer chamber 44. The outlet 48 may be a hole or channel formed at the discharge end of the buffer chamber 44.

The positions of the centers of the inlet 46 and the outlet 48 formed in the buffer chamber 44 may be different. Here, a center 46*c* of the inlet 46 may refer to the center of the hole or channel formed by the inlet 46. Likewise, a center 48*c* of the outlet 48 may refer to the center of the hole or channel formed by the outlet 48.

Referring to FIG. 8, the center 46*c* of the inlet 46 of the buffer chamber 44 may be formed above the center 48*c* of the outlet 48 of the buffer chamber 44. Referring to FIG. 11, in some examples, the center 46*c* of the inlet 46 of the buffer chamber 44 may also be formed above the center 48*c* of the outlet 48 of the buffer chamber 44.

In some examples, unlike the examples of FIGS. 8 and 11, the center 46*c* of the inlet 46 of the buffer chamber 44 and the center 48*c* of the outlet 48 of the buffer chamber 44 may be spaced apart in the width direction.

The sizes of the inlet 46 and the outlet 48 formed in the buffer chamber 44 may be different from each other. The size of the inlet 46 formed in the buffer chamber 44 may be smaller than the size of the outlet 48.

The size of the outlet 48 formed in the buffer chamber 44 may be formed in a size corresponding to the air intake channel 56. The size of the outlet 48 formed in the buffer chamber 44 may be formed at a level where the pressure of the washing water flowing through the air intake channel 56 can form negative pressure.

The size of the inlet 46 formed in the buffer chamber 44 may be formed to correspond to the channel cross-sectional area of the connection channel 42. The size of the inlet 46 formed in the buffer chamber 44 can be formed so that the flow rate of washing water flowing into the connection channel 42 can be adjusted. The flow rate of washing water flowing through the connection channel 42 may be relatively lower than the flow rate of washing water flowing through the spray channels 14*a* and 14*b*.

An inner protrusion 58 protruding from one side of the outlet 48 is disposed in the spray arm 10 to change the center 48*c* of the outlet 48. The inner protrusion 58 protrudes to one side of the outlet 48 to change the center of the outlet 48. Referring to FIG. 8, the inner protrusion 58 may be formed on the upper side of the outlet 48. The inner protrusion 58 can move the center of the outlet 48 of the buffer chamber 44 downward. Accordingly, the separation distance between the center 46*c* of the inlet 46 of the buffer chamber 44 and the center 48*c* of the outlet 48 may increase.

In the buffer chamber 44 of the present disclosure, the positions of the centers of the inlet 46 and the outlet 48 are different from each other, so that the flow rate of the washing water flowing into the buffer chamber 44 through the inlet 46 is reduced inside the buffer chamber 44, and thereafter, the flow rate of washing water passing through the outlet 48 through the reduction portion 54 may increase. In other words, the change in flow rate of washing water flowing into the inlet 46 of the buffer chamber 44 and flowing to the outlet 48 can be changed to decrease and then increase. When the positions of the centers of the inlet 46 and the outlet 48 formed in the buffer chamber 44 are the same, there will be little change in the flow rate of the washing water flowing through the inlet 46 to the outlet 48, which may cause the pressure of the washing water flowing through the air intake channel 56 to be higher than the negative pressure. That is, microbubbles may not be actively formed because the rate at which external air is suctioned into the air intake channel 56 is low.

In some implementations, the positions of the centers of the inlet 46 and the outlet 48 of the buffer chamber 44 are formed differently from each other, so that the flow rate of the washing water flowing through the buffer chamber 44 is reduced and increased, and thus, a negative pressure may be formed in the washing water flowing through the air intake channel 56.

The expansion portion 50 may begin with a channel area larger than the inlet 46. Referring to FIGS. 8 and 11, the expansion portion 50 may begin with the expansion portion 50 expanded downward beyond the inlet 46 of the buffer chamber 44 connected to the connection channel 43.

The air intake channel 56 is connected to the buffer chamber 44. The washing water flowing in the buffer chamber 44 may flow to the air intake channel 56. The channel cross-sectional area of the air intake channel 56 may be smaller than the channel cross-sectional area of the buffer chamber 44. The channel cross-sectional area of the air intake channel 56 may be smaller than the channel cross-sectional area of the channel formed in the maintenance portion 52. Accordingly, the washing water flowing through the air intake channel 56 may form negative pressure.

The air intake channel 56 is connected to an air flow channel 60 on one side. External air may flow into the air flow channel 60 through the intake hole 64 formed on one side of the spray arm 10.

The air flow channel 60 may be connected to the downstream end portion of the air intake channel 56. The air flow channel 60 may be connected to a peripheral surface of the air intake channel 56. The air flow channel 60 may be disposed on the peripheral surface of the air intake channel 56 at a portion where the discharge end portion of the air intake channel 56 is formed. Therefore, it is possible to prevent air introduced into the air intake channel 56 from flowing into the buffer chamber 44.

Figure 6:
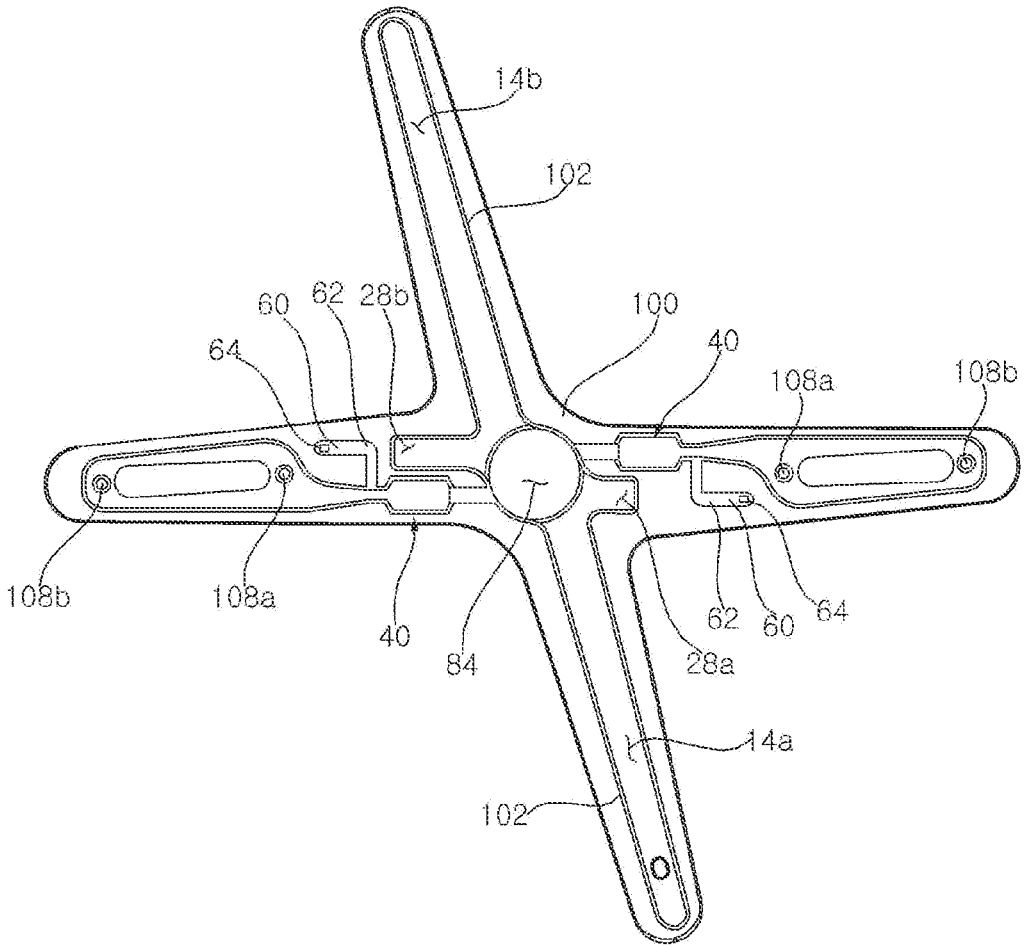
FIG. 6 is a plan view showing an example of a lower cover.
Figure 7:
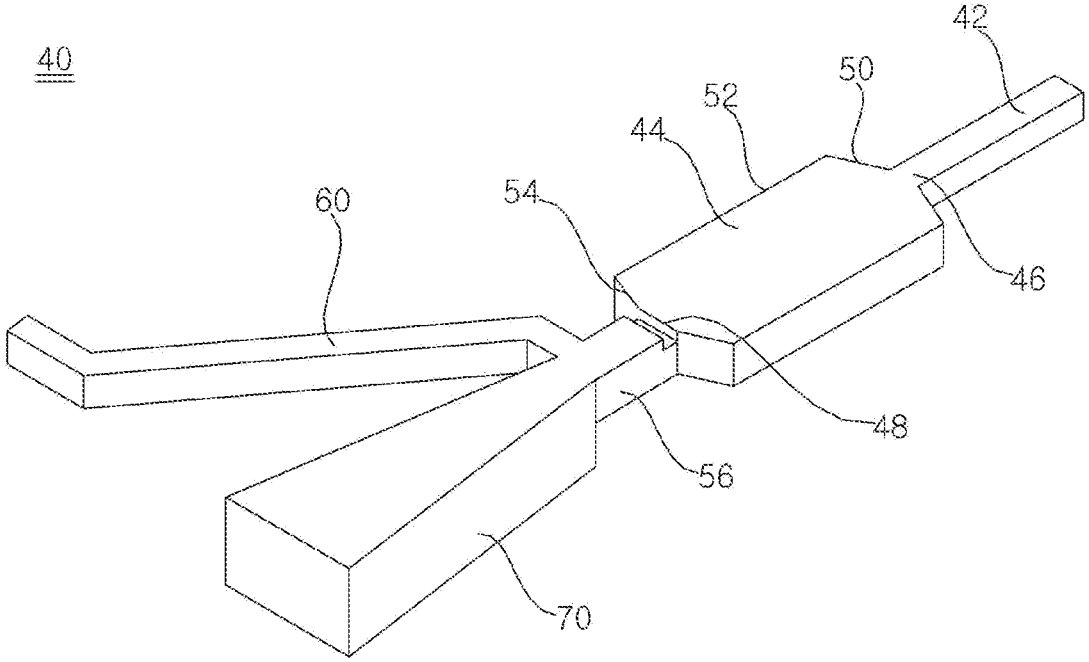
FIG. 7 is a perspective view showing an example of a bubble generating channel.

The intake hole 64 may be formed on the lower surface of the spray arm 10. Referring to FIG. 6, the intake hole 64 may be formed in the lower cover 100. Therefore, it is possible to prevent washing water falling from the upper side from flowing into the air flow channel 60 through the intake hole 64. The air flow channel 60 may include at least one bending portion 62 through which the flow direction of the channel changes.

The air flow channel 60 may be connected perpendicularly to the air intake channel 56. Accordingly, the air flowing into the air intake channel 56 from the air flow channel 60 may flow perpendicular to the flow direction of the washing water flowing through the air intake channel 56. Since the air flowing into the air intake channel 56 flows perpendicular to the flow direction of the washing water flowing through the air intake channel 56, the air may be primarily crushed due to friction with the flowing washing water.

The discharge channel 70 is connected to the air intake channel 56. The cross-sectional area of the discharge channel 70 may increase from the inlet end connected to the air intake channel 56 toward the flow direction of the washing water. The channel cross-sectional area of the inlet end 70*a* of the discharge channel 70 is larger than the channel cross-sectional area of the discharge end 56*a* of the air intake channel 56. The channel cross-sectional area of the inlet end 70*a* of the discharge channel 70 may be 1.5 to 2.5 times the channel cross-sectional area of the discharge end 56*a* of the air intake channel 56. Accordingly, pressure is temporarily applied to the washing water discharged from the air intake channel 56 and flowing into the discharge channel 70, and the air contained in the washing water may be secondarily destroyed.

The discharge channel 70 may have a cross-sectional area that increases toward the flow direction of the washing water. Accordingly, the air contained in the washing water flowing along the discharge channel 70 may be additionally crushed. The discharge channel 70 includes a pressurized portion 72 in which the cross-sectional area of the channel increases in the flow direction of the washing water.

Below, with reference to FIG. 13, the bubble generating channel will be described.

Figure 13:
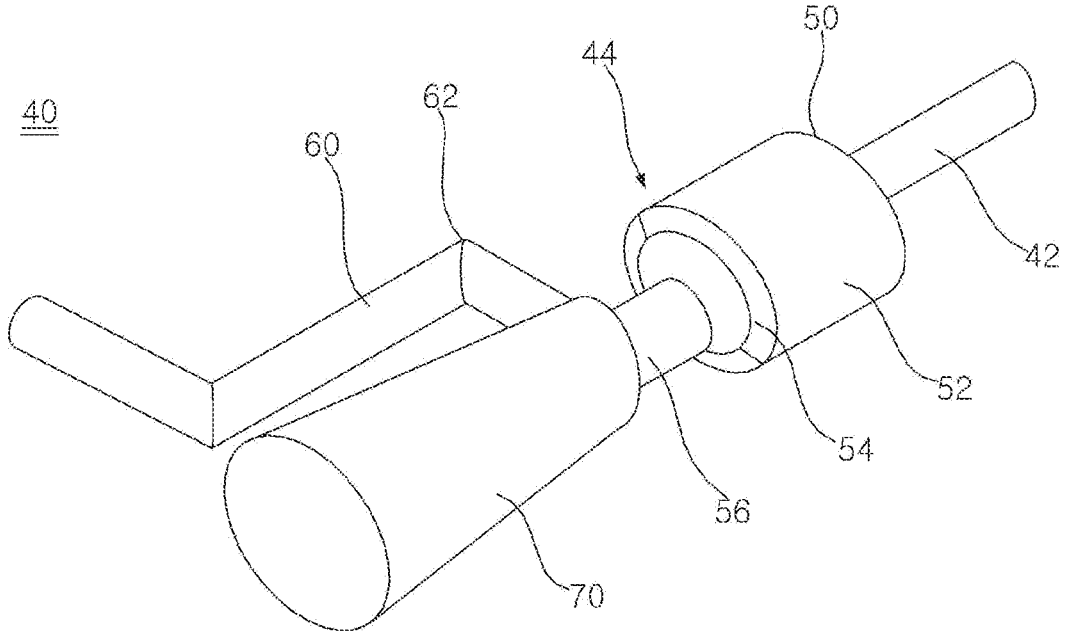
FIG. 13 is a perspective view showing an example of a bubble generating channel.

In some implementations, referring to FIG. 13, the bubble generating channel 40 may include the connection channel 42 which is connected to the supply channel 84 of the hub 82, the buffer chamber 44 which is connected to the connection channel 42 and of which a cross-sectional area of the channel increases, the air intake channel 56 which is connected to the buffer chamber 44 and through which external air flows in, and the discharge channel 70 which is connected to the air intake channel 156 and through which the washing water having the generated microbubbles is discharged. In addition, the bubble generating channel 40 may include the downstream end portion of the air intake channel 56 and the air flow channel 60 that supplies the external air introduced through the intake hole 64 to the air intake channel 56.

The buffer chamber 44 includes the expansion portion 50 in which the cross-sectional area of the channel increases, the maintenance portion 52 in which the cross-sectional area of the channel is maintained, and the reduction portion 54 in which the cross-sectional area of the channel is reduced. The positions of the inlet and outlet of the buffer chamber 44 may be different from each other.

Referring to FIG. 13, in some examples, the bubble generating channel 40 may have a circular or oval cross-sectional shape.

Hereinafter, with reference to FIG. 14, a bubble generating channel will be described.

Figure 14:
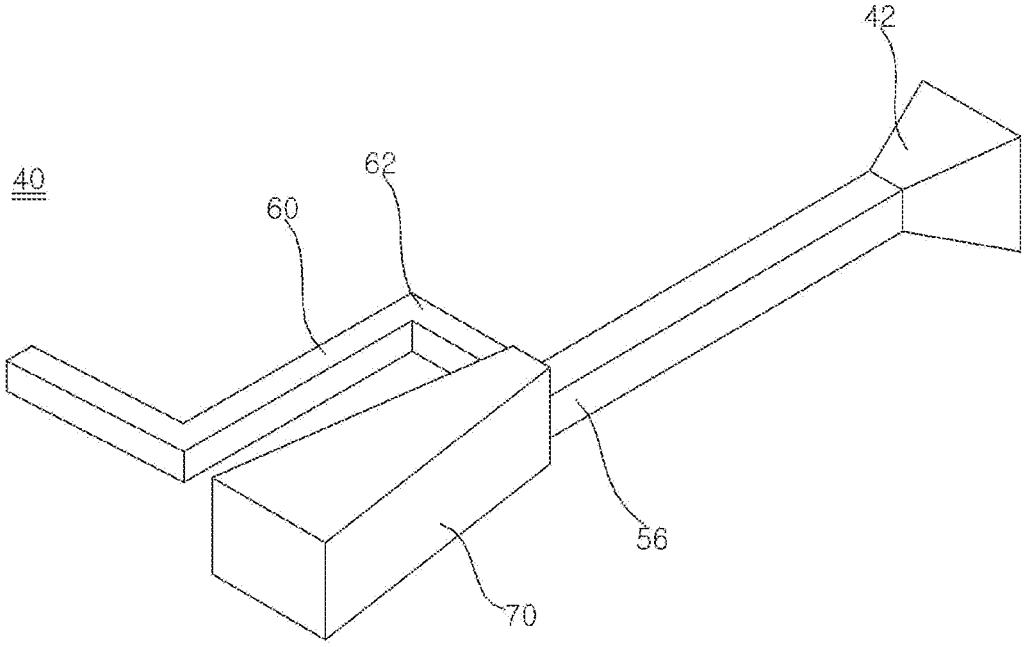
FIG. 14 is a perspective view showing an example of a bubble generating channel.

Referring to FIG. 14, in some examples, the bubble generating channel 40 includes the connection channel 42 which is connected to the supply channel 84 of the hub 82, the air intake channel 56 which is connected to the connection channel 42 and through which external air flows in, and the discharge channel 70 which is connected to the air intake channel 156 and through which the washing water having the generated microbubbles is discharged. In addition, the bubble generating channel 40 may include the downstream end portion of the air intake channel 56 and the air flow channel 60 that supplies the external air introduced through the intake hole 64 to the air intake channel 56.

The bubble generating channel 40 may include the downstream end portion of the air intake channel 56 and the air flow channel 60 that supplies the external air introduced through the intake hole 64 to the air intake channel 56.

Referring to FIG. 14, in some examples, the bubble generating channel 40 may not include a separate buffer chamber. The connection channel 42 may have a reduced cross-sectional area to reduce the pressure of the flowing washing water.

Hereinafter, with reference to FIGS. 3 to 6 and FIGS. 15 to 18, the structure of the channel formed inside the spray arm will be described.

In some implementations, protruding inner ribs 94*a* and 94*b* are disposed on the upper cover 90 or lower cover 100 and define a channel through which the washing water flows.

In the spray arm 10 of the present disclosure, a flat surface may be formed in one of the upper cover 90 and lower cover 100, and the ribs 94*a* and 94*b* protruding to the flat surface and coming into contact with the flat surface may be formed in the other of the upper cover 90 and lower cover 100. The ribs 94*a* and 94*b* may come into contact with the flat surface 104 to form the channel through which washing water flows.

Figure 15:
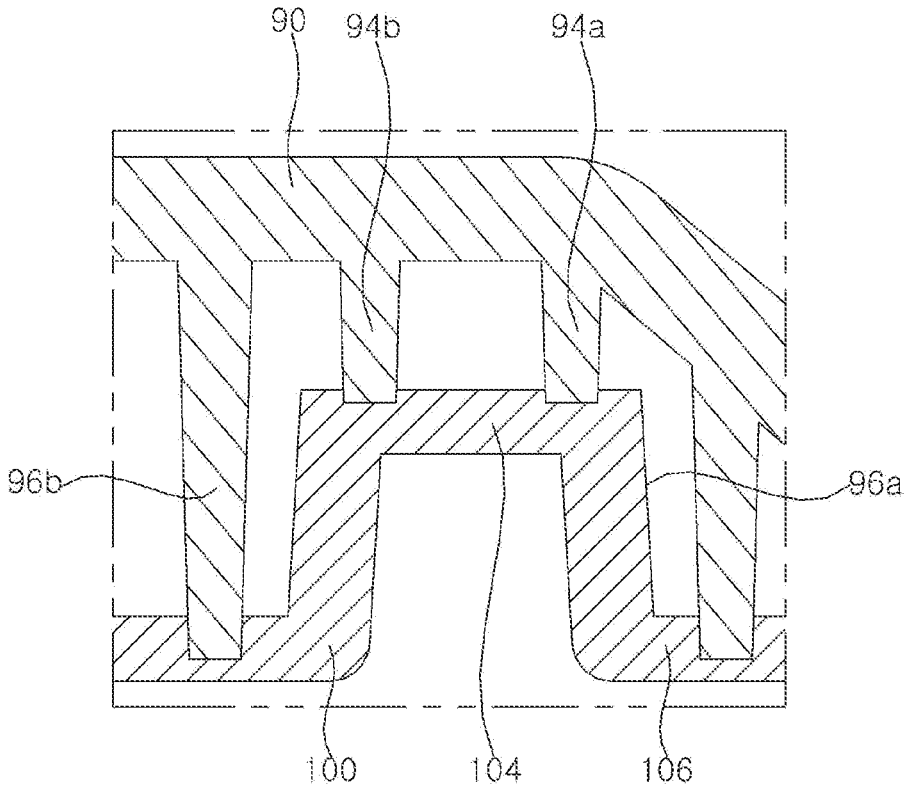
FIG. 15 is a cross-sectional view taken along line X-X' of FIG. 4, illustrating an example of a channel cross-sectional shape of the connection channel and a coupling relationship of the corresponding portion.
Figure 16:
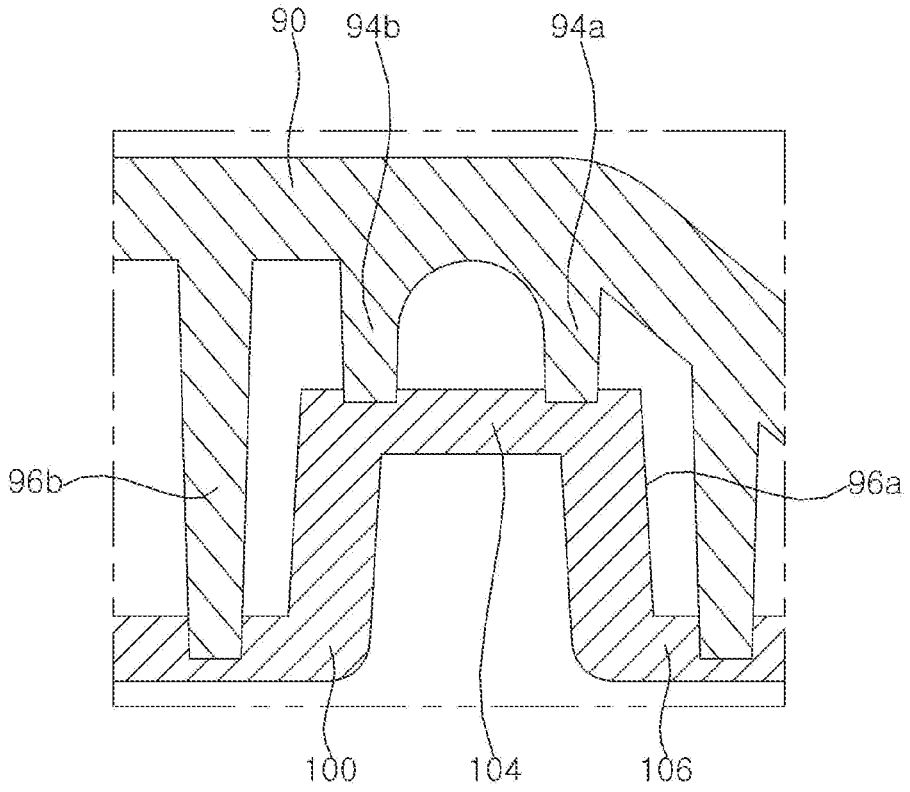
FIG. 16 is a view illustrating an example of a channel cross-sectional shape of the connection channel.
Figure 17:
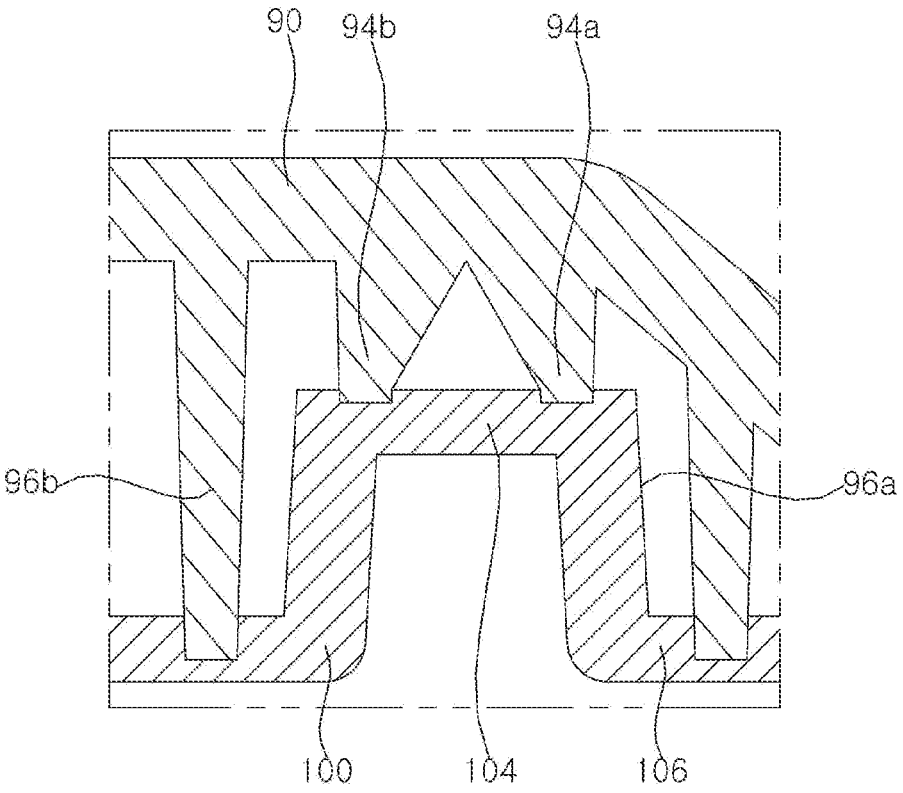
FIG. 17 is a view illustrating an example of a channel cross-sectional shape of the connection channel.
Figure 18:
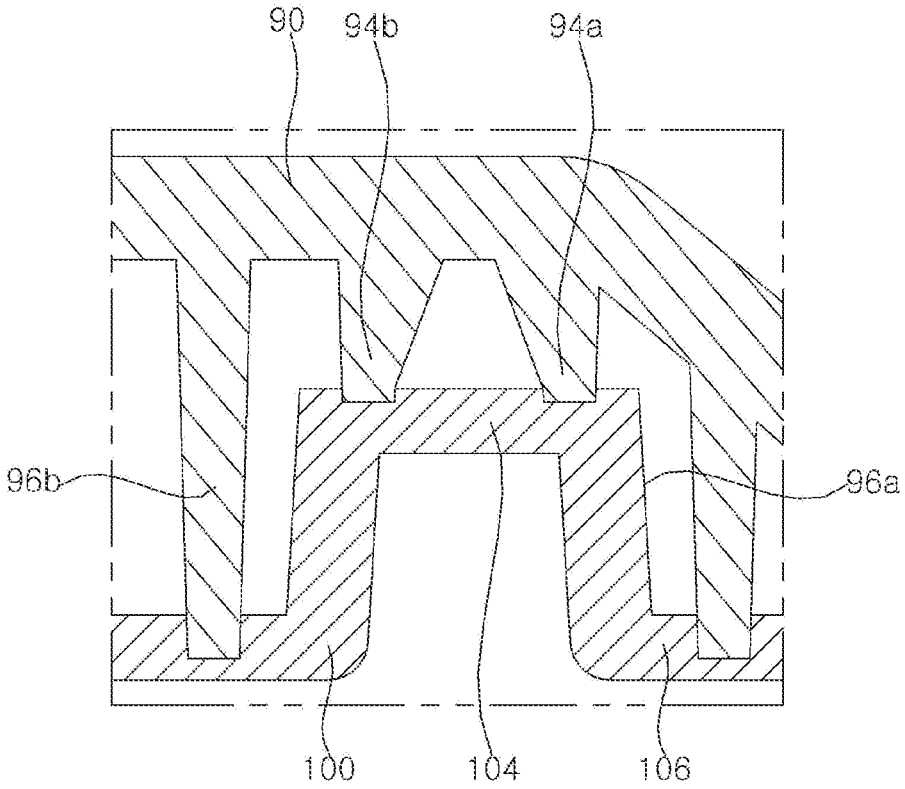
FIG. 18 is a view illustrating an example of a channel cross-sectional shape of the connection channel.

Referring to FIG. 15, the lower cover 100 forms the flat surface 104, and the pair of ribs 94*a* and 94*b* extending to the flat surface 104 of the lower cover 100 protrudes from the upper cover 90. The pair of ribs 94*a* and 94*b* extend downward from the upper cover 90. The pair of ribs 94*a* and 94*b* is arranged to be in contact with the flat surface 104 of the lower cover 100. In a state where the pair of ribs 94*a* and 94*b* in contact with the flat surface 104 of the lower cover 100, the upper cover 90 and the lower cover 100 may be fused.

Specifically, in the connection channel 42 formed in the spray arm 10, the pair of ribs 94 and 94*b* protruding from the other of the upper cover 90 and the lower cover 100 is in contact with the flat surface 104 formed in one of the upper cover 90 and the lower cover 100, and thus, the connection channel 42 is formed. Referring to FIG. 15, the pair of ribs 94*a* and 94*b* protruding from the upper cover 90 is in contact with the flat surface 104 formed in the lower cover 100, and thus, the connection channel 42 may be formed.

The connection channel 42 may have a small diameter so that only a portion of the washing water flowing through the supply channel 84 of the hub 82 flows into the bubble generating channel 40. As in the present disclosure, one cover forms a flat surface, and the channel may be formed by a coupling of the pair of ribs protruding from the other cover. In this structure, the area of the channel or the center of the channel can be maintained even when there is some error due to the fusion of the upper cover 90 and the lower cover 100.

The flat surface 104 of the lower cover 100 may be disposed to be spaced upward from the bottom surface 106 formed by the lower cover 100. The support ribs 96*a* and 96*b* may be disposed in the upper cover 90 to support the arrangement of the pair of ribs 94*a* and 94*b* forming the connection channel 42. The support ribs 96*a* and 96*b* may be provided as a pair disposed outside each of the pair of ribs 94*a* and 94*b*. That is, referring to FIG. 15, each of the pair of support ribs 96*a* and 96*b* may be spaced apart from the outside of each of the pair of ribs 94*a* and 94*b* and disposed to be in contact with the bottom surface 106 of the lower cover 100. The pair of support ribs 96*a* and 96*b* may be fused to each other in a state of being in contact with the bottom surface 106 of the lower cover 100.

Referring to FIG. 15, the connection channel 42 may be a channel having a rectangular cross-section. The rectangular cross-sectional channel shape according to FIG. 15 is just an example. In some implementations, various channel shapes are possible in the channel structure defined by a flat surface and a pair of ribs in contact with the flat surface. For instance, a semicircular cross-sectional structure as in FIG. 16, a triangular cross-sectional structure as in FIG. 17, and a trapezoidal cross-sectional structure as in FIG. 18 may be provided.

The discharge channel 70 is connected to the air intake channel 56, and can discharge the washing water discharged from the air intake channel 56 into the tub 2 through the discharge holes 108*a*, 108*b*, and 118.

The discharge channel 70 can additionally pulverize the air contained in the washing water discharged from the air intake channel 56. The cross-sectional area of the discharge channel 70 may increase from the inlet end toward the flow direction of the washing water. Accordingly, pressure is applied to the washing water flowing from the inlet end of the discharge channel 70 in the flow direction of the washing water, and thus, the air contained in the washing water may be additionally crushed.

The discharge channel 70 includes the pressurized portion 72 which is connected to the air intake channel 56 and in which the channel is expanded, and a discharge portion 74 which is disposed downstream of the pressurized portion 72 and in which the discharge holes 108*a*, 108*b*, 118 are formed.

The pressurized portion 72 connects the air intake channel 56 and the discharge portion 74, the cross-sectional area of the channel increases in the direction away from the rotation axis of the spray arm 10, and thus, the pressure on the flowing washing water may increase. Accordingly, the air contained in the washing water flowing along the pressurized portion 72 may be additionally crushed. The air contained in the washing water discharged from the air intake channel 56 and flowing through the pressurized portion 72 may be additionally crushed to form microbubbles.

The discharge portion 74 is formed in the direction in which the second blade 18 extends, and is configured to discharge the washing water having the generated microbubbles into the tub 2 through the discharge holes 108*a*, 108*b*, 118 formed on one side. The discharge holes 108*a*, 108*b*, and 118 are disposed on the channel formed by the discharge portion 74, so that the washing water flowing through the discharge portion 74 may be discharged to the outside of the second blade 18 through the discharge holes 108*a*, 108*b*, and 118.

The discharge holes 108*a*, 108*b*, and 118 are the first discharge hole 118 disposed on the side walls 24 and 110 of the second blade 18 and the second discharge hole 108*a* and 108*b* disposed on the lower surface of the second blade 18.

The first discharge hole 118 is formed on the side walls 24 and 110 of the second blade 18. Here, the side walls 24 and 110 of the second blade 18 may face a direction perpendicular to the rotation axis of the spray arm 10. For example, the side walls 24 and 110 define a vertical surface. In some implementations, the side walls 24 and 110 may face a direction inclined upward from the direction perpendicular to the rotation axis of the spray arm 10. The side walls 24 and 110 may be defined at the upper cover 90. The side walls 24 and 110 may be formed in the inner side wall 110.

The first discharge hole 118 may be opened in a direction perpendicular to the rotation center axis 10*c* of the spray arm 10 or in a direction inclined upward from the vertical direction to the rotation center axis 10*c* of the spray arm 10. The washing water that is sprayed into the washing space through the spray nozzles 16*a* and 16*b* of the first blades 12*a* and 12*b* and falls may fall into the first discharge hole 118. The washing water sprayed and dropped from the first blades 12*a* and 12*b* may hit the washing water discharged from the first discharge hole 118, thereby further pulverizing the microbubbles.

The second discharge holes 108*a* and 108*b* may be formed in the lower cover 100. The second discharge holes 108*a* and 108*b* can discharge the washing water remaining in the bubble generating channel 40 to the tub 2. The second discharge holes 108*a* and 108*b* can discharge the washing water remaining in the discharge channel 70 into the tub 2. That is, when the operation of the washing pump stops, the washing water can be prevented from remaining in the bubble generating channel 40.

Hereinafter, with reference to FIGS. 19 to 22, the arrangement of the first discharge hole 118 and the structure of the discharge channel 70 will be described.

Figure 19:
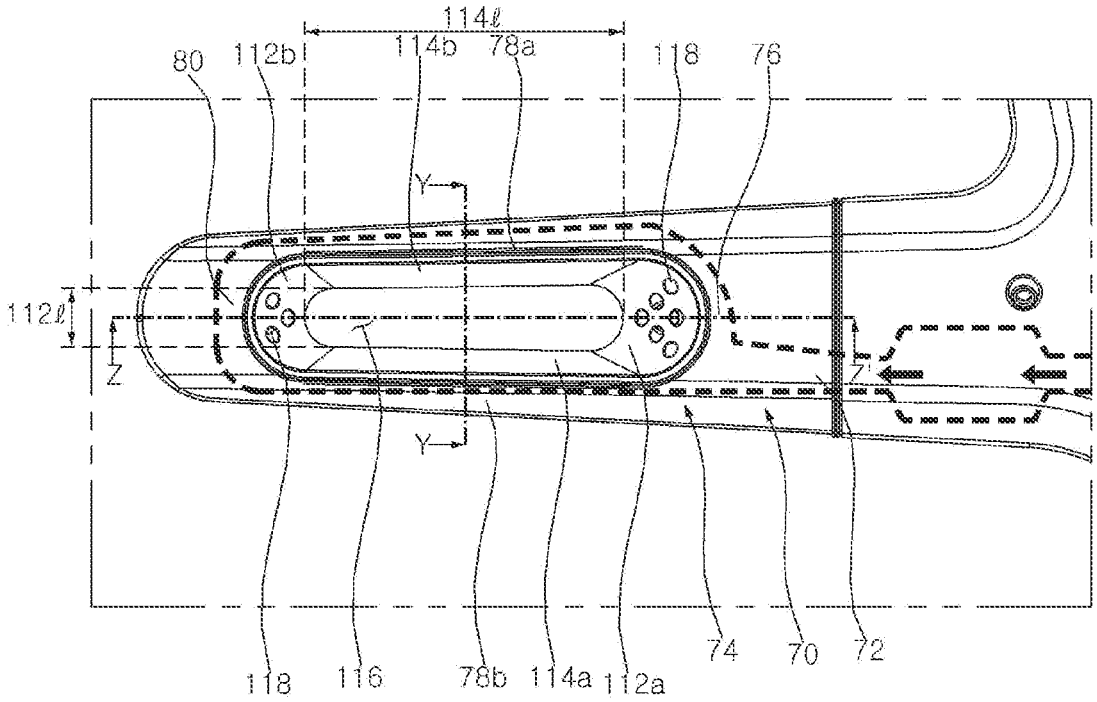
FIG. 19 is an enlarged view of portion A of FIG. 4.
Figure 20:
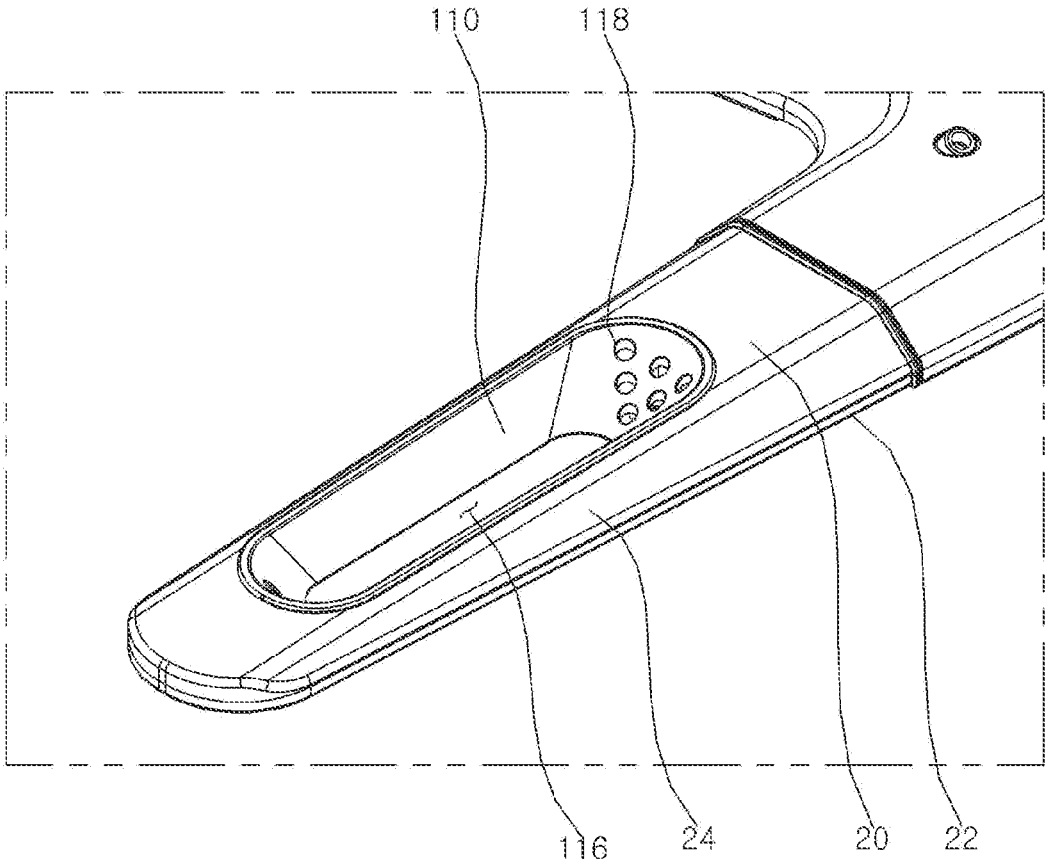
FIG. 20 is an enlarged view of part B of FIG. 2.

Referring to FIG. 19, in some implementations, the second blade 18 includes an upper wall 20 disposed to face upward, a lower wall 22 disposed to face downward, and side walls 24 and 110 connecting the upper wall 20 and the lower wall 22. The side walls 24 and 110 may form a surface facing in a direction perpendicular to the rotation center axis 10*c* of the spray arm 10, or form a surface facing upward from the direction perpendicular to the rotation center axis 10*c* of the spray arm 10.

The side walls 24 and 110 include an outer side wall 24 that connects the upper wall 20 and the lower wall 22 and forms the outer perimeter of the second blade 18, and an inner side wall 110 that connects the upper wall 20 and the lower wall 22 and is formed around the vertical hole 116 formed in the second blade 18.

Referring to FIG. 19, the upper wall 20 and the outer side wall 24 are disposed in the upper cover 90. The lower wall 22 is disposed in the lower cover 100. The outer side wall 24 may be disposed in the lower cover 100. Referring to FIG. 19, the first discharge hole 118 is formed in the inner side wall 110. In some implementations, the first discharge hole may be formed in the outer side wall 24.

The first discharge hole 118 is formed in the inner side wall 110. The inner side wall 110 forms the vertical hole 116 that is open in the up-down direction. The inner side wall 110 may form a peripheral wall around the vertical hole 116. The inner side wall 110 may form a surface facing in a direction perpendicular to the rotation center axis 10*c* of the spray arm 10, or form a surface facing upward from the direction perpendicular to the rotation center axis 10*c* of the spray arm 10.

The inner side wall 110 is formed such that the cross-sectional area of the inner peripheral surface of the upper end portion is larger than the cross-sectional area of the inner peripheral surface of the lower end portion. The inner side wall 110 has an oval pillar shape. The inner side wall 110 has a shape inclined toward the upper side. The inner side wall 110 may be disposed in the second blade 18 and may be the side wall 24 or 110 on which the first discharge hole 118 is formed.

The inner side wall 110 may include a pair of long walls 114*a* and 114*b* formed in the direction in which the second blade 18 extends and a pair of short walls 112*a* and 112*b* connecting both end portions of the pair of long walls 114*a* and 114*b*. The pair of short walls 112*a* and 112*b* includes a first short wall 112*a* disposed adjacent to the air intake channel 56 and a second short wall 112*b* disposed adjacent to an end portion of the second blade 18.

Figure 21:
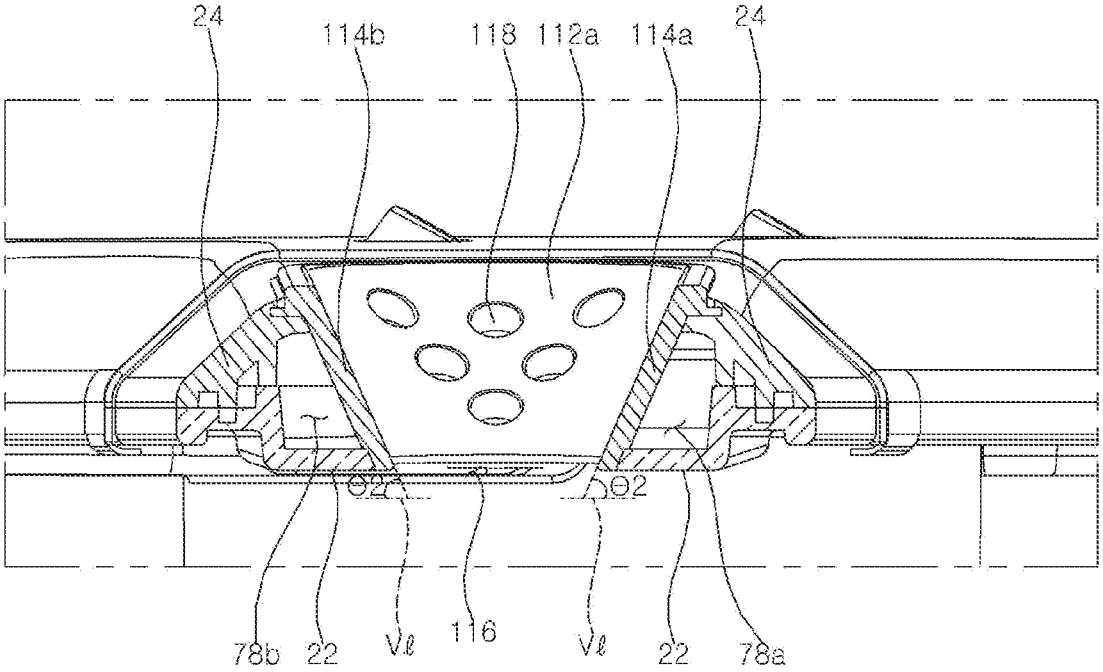
FIG. 21 is a cross-sectional view taken along line Y-Y' of FIG. 20.
Figure 22:
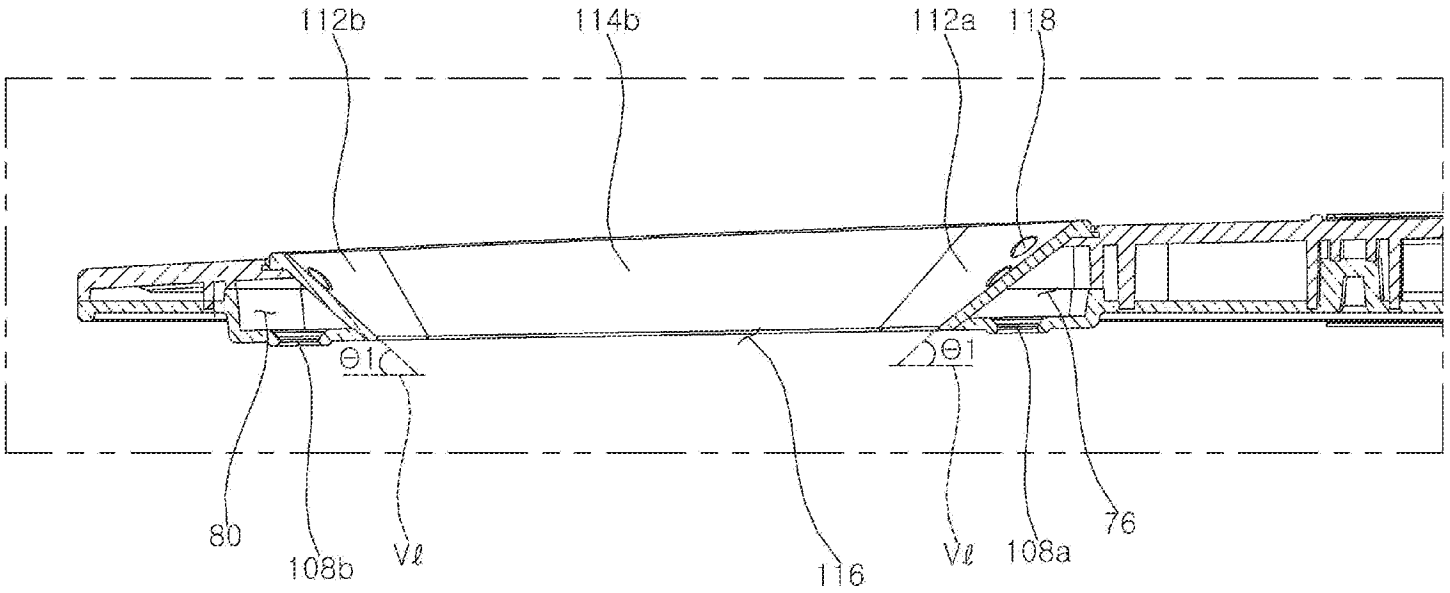
FIG. 22 is a cross-sectional view taken along Z-Z' of FIG. 20.

A plurality of first discharge holes 118 are formed in the pair of short walls 112*a* and 112*b*. Referring to FIGS. 21 and 22, an inclination angle θ1 formed between the short walls 112*a* and 112*b* where the first discharge hole 118 is formed and a virtual horizontal line v1 is smaller than an inclination angle θ2 formed between the long walls 114*a* and 114*b* and the virtual horizontal line v1. Accordingly, the short walls 112*a* and 112*b* in which the plurality of first discharge holes 118 are formed may form an inclined surface inclined more upward than the long walls 114*a* and 114*b*.

A length 114*l* of the long walls 114*a* and 114*b* in the direction in which the second blade 18 extends is longer than a length 1121 of the short wall 112*a* and 112*b* in the direction perpendicular to the long walls 114*a* and 114*b*. Referring to FIG. 19, the long walls 114*a* and 114*b* may have the shape of straight surfaces. Referring to FIG. 19, the short wall 112*a* and 112*b* may have a curved shape.

In the discharge portion 74, the washing water flowing from the pressurized portion 72 is branched from the first short wall 112*a*. Therefore, the flow of the washing water may temporarily stagnate around the first short wall 112*a*, and the stagnant washing water may flow into the tub 2 through the first discharge hole 118 formed in the first short wall 112*a*.

The discharge portion 74 includes a pair of extension channels 78*a* and 78*b* formed outside the pair of long walls 114*a* and 114*b*, a branch channel 76 that is connected to the pressurized portion 72 and branches from each of the pair of extension channels 78*a* and 78*b*, and a combined channel 80 in which a pair of extension channels 78*a* and 78*b* are combined.

The pair of extension channels 78*a* and 78*b* are formed outside the pair of long walls 114*a* and 114*b*. The pair of extension channels 78*a* and 78*b* extend along each of the pair of long walls 114*a* and 114*b*. Each of the pair of extension channels 78*a* and 78*b* connects the branch channel 76 and the combined channel 80 to each other.

The second discharge holes 108*a* and 108*b* are formed in the lower portions of each of the branch channel 76 and the combined channel 80.

Figure 23:
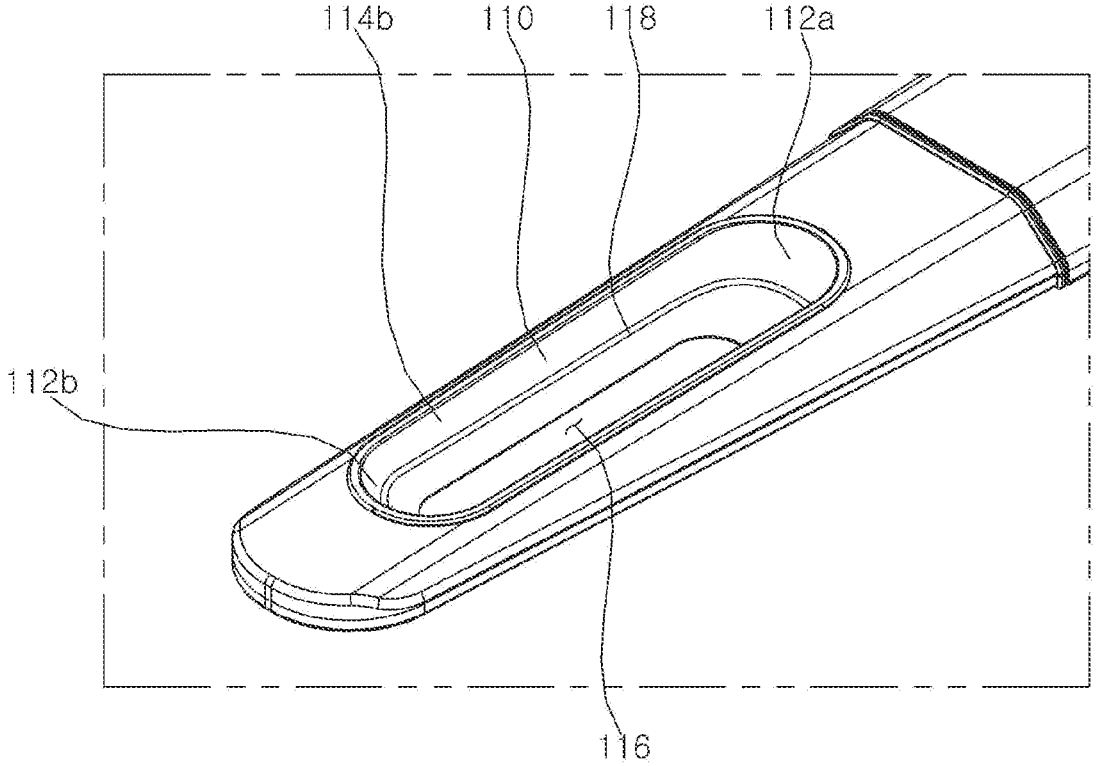
FIG. 23 is a perspective view showing an example of a second blade including a water collection cover with a discharge hole.

Referring to FIG. 23, the first discharge hole 118 may be formed along the inner peripheral surface of the inner side wall 110. That is, the first discharge hole 118 may be formed in each of the short wall 112*a* and 112*b* and the long walls 114*a* and 114*b* of the inner side wall 110.

Figure 24:
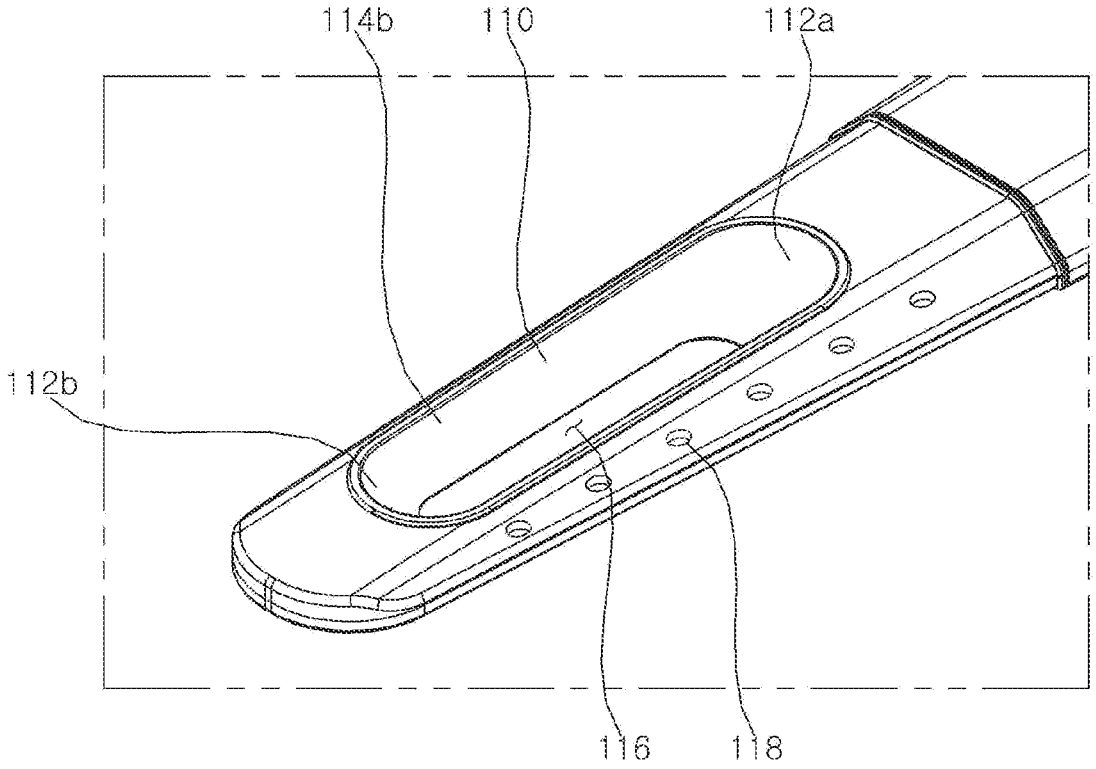
FIG. 24 is a view for explaining an example of a discharge hole in the second blade.

Referring to FIG. 24, the first discharge hole 118 may be disposed in the outer side wall 24. The plurality of first discharge holes 118 may be spaced apart in the direction in which the second blade 18 extends.

Figure 25:
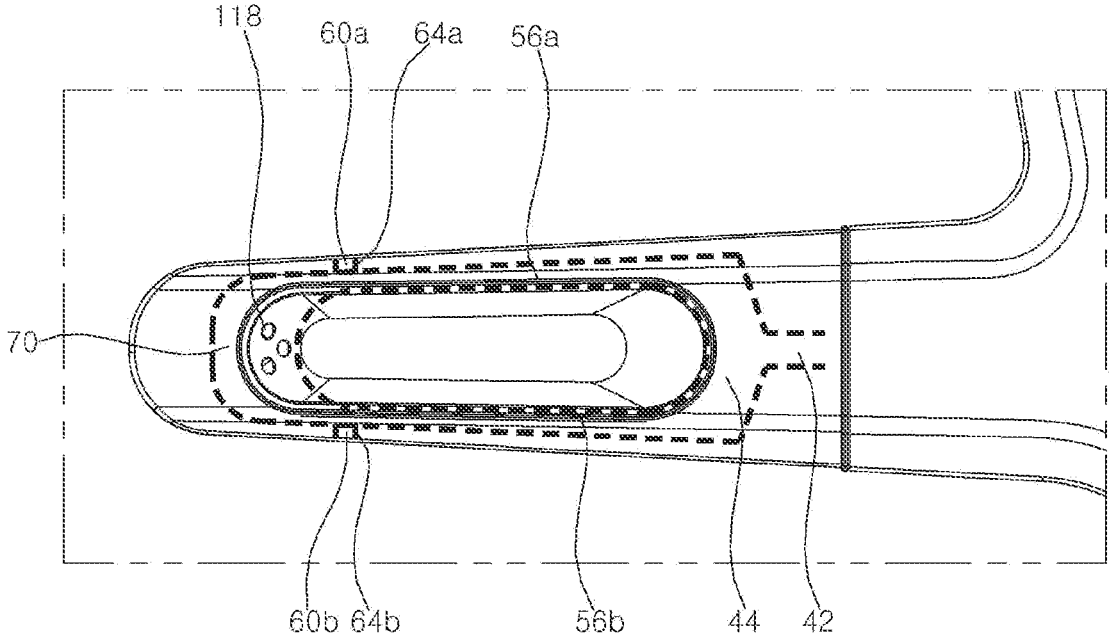
FIG. 25 is a view for explaining an example of a bubble generating channel inside the second blade.

Referring to FIG. 25, the bubble generating channel 40 may be formed around the side walls 24 and 110. That is, the bubble generating channel 40 includes the connection channel 42 which is connected to the hub 82, the buffer chamber 44 which is connected to the connection channel 42 and in which the cross-sectional area of the channel increases or decreases, the air intake channels 56*a* and 56*b* which are connected to the buffer chamber 44 and in which a reduced channel cross-sectional area is maintained, and the discharge channel 170 which is connected to the air intake channels 56*a* and 56*b*, has an expanded channel cross-sectional area, and discharges the washing water to the discharge hole 118.

Referring to FIG. 25, the bubble generating channel 40 includes a pair of air intake channels 56*a* and 56*b*. A pair of air flow channels 60*a*, 60*b* through which external air flows in are connected to each of the pair of air intake channels 56*a* and 56*b*. Each of the pair of air flow channels 60*a* and 60*b* supplies external air flowing in from a pair of intake holes 64*a* and 64*b* formed on one side to each of the pair of air intake channels 56*a* and 56*b*.

The buffer chamber 44 may be connected to each of the pair of air intake channels 56*a* and 56*b*. That is, the washing water flowing into the buffer chamber 44 can flow into each of the pair of air intake channels 56*a* and 56*b*. Referring to FIG. 25, the connection channel 42 may be connected to the buffer chamber 44 at the center of the second blade 18 in the width direction. The pair of air intake channels 56*a* and 56*b* may be connected at both end portions of the buffer chamber 44 in the width direction. That is, the centers of the inlet and outlet of the buffer chamber 44 may be spaced apart in the width direction of the second blade 18.

In the above, one or more implementations of the present disclosure have been illustrated and described, but the present disclosure is not limited to the specific embodiments described above. That is, the present disclosure can be modified in various ways by a person with ordinary knowledge in the technical field to which the disclosure belongs without departing from the gist of the present disclosure as claimed in claims, and these modified implementations should not be understood individually from the technical ideas or perspectives of this disclosure.

What is claimed is:

1. A dishwasher comprising:

a tub that defines a washing space;

a sump disposed below the tub and configured to store washing water received from the tub;

a pump configured to supply the washing water stored in the sump to the washing space; and a spray arm configured to discharge the washing water from the pump into the washing space, wherein the spray arm defines a channel therein configured to carry the washing water received from the pump, the spray arm being configured to spray the washing water or the washing water including microbubbles into the washing space, wherein the spray arm comprises an upper cover and a lower cover that have inner surfaces facing each other, the lower cover being coupled to a lower side of the upper cover, wherein the spray arm has:

a flat surface that is defined at one of the inner surfaces of the upper cover and the lower cover, and a pair of inner ribs that protrude from the other of the inner surfaces of the upper cover and the lower cover to the flat surface, the pair of inner ribs being in contact with the flat surface to thereby define the channel between the pair of inner ribs, wherein the spray arm comprises:

a first blade configured to spray the washing water into the washing space, and a second blade configured to supply the washing water including the microbubbles to the washing space, wherein the channel comprises (i) a spray channel defined inside the first blade and (ii) a bubble generating channel defined inside the second blade, wherein the upper cover comprises an upper rib that protrudes downward, and the lower cover comprises a lower rib that protrudes upward to the upper rib to thereby define the spray channel between the upper cover and the lower cover, and wherein the flat surface and the pair of inner ribs are disposed in the second blade and define at least a portion of the bubble generating channel.

2. The dishwasher of claim 1, wherein the upper cover and the lower cover are coupled to each other by fusion in a state in which the pair of inner ribs are in contact with the flat surface.

3. The dishwasher of claim 1, wherein the flat surface is disposed above and spaced apart from a bottom surface of the lower cover, and wherein the pair of inner ribs protrude downward from the upper cover.

4. The dishwasher of claim 3, wherein the upper cover further comprises a pair of support ribs that are spaced apart from the pair of inner ribs and protrude toward the lower cover.

5. The dishwasher of claim 4, wherein the pair of support ribs protrude from the upper cover to the bottom surface of the lower cover and are in contact with the bottom surface of the lower cover.

6. The dishwasher of claim 1, wherein the channel defined by the pair of inner ribs and the flat surface has a rectangular cross section.

7. The dishwasher of claim 1, wherein a cross section of the channel has (i) a first side that is defined by a straight line and (ii) a second side that is defined by a curved line, bent lines, or a plurality of straight lines.

8. The dishwasher of claim 1, wherein the spray arm defines (i) an intake hole that is in fluid communication with an outside of the spray arm and configured to provide air to the bubble generating channel and (ii) a supply channel configured to supply the washing water discharged from the pump to at least one of the spray channel or the bubble generating channel, wherein the bubble generating channel comprises:

a connection channel connected to the supply channel, the connection channel being defined by the flat surface and the pair of inner ribs, a buffer chamber connected to the connection channel and the intake hole, the buffer chamber having a cross-sectional area that increases and then decreases along a direction away from the connection channel, an air intake channel configured to receive the air from the intake hole via an air flow channel, and a discharge channel connected to the air intake channel, the discharge channel having a cross-sectional area that increases in a direction away from the air intake channel, and wherein the spray arm further defines a discharge hole configured to discharge the washing water from the discharge channel to the outside of the spray arm.

9. The dishwasher of claim 8, wherein a cross-sectional area of the connection channel is smaller than a cross-sectional area of an inlet end of the supply channel.

10. The dishwasher of claim 8, wherein a cross-sectional area of the connection channel is smaller than a cross-sectional area of the air intake channel.

11. The dishwasher of claim 1, wherein the flat surface is defined at the inner surface of the lower cover, and the pair of inner ribs protrude downward from the inner surface of the upper cover toward the lower cover.

12. The dishwasher of claim 11, wherein the flat surface protrudes upward from a bottom surface of the lower cover to the pair of inner ribs of the upper cover.

13. The dishwasher of claim 12, wherein a channel height of the channel between the flat surface and the inner surface of the upper cover is less than a height of the flat surface protruding from the bottom surface of the lower cover.

14. The dishwasher of claim 11, wherein the flat surface extends laterally outward relative to the pair of inner ribs, and a channel width of the channel between the pair of inner ribs is less than a lateral width of the flat surface.

* * * * *